US008807781B2

(12) United States Patent
Weber

(10) Patent No.: US 8,807,781 B2
(45) Date of Patent: Aug. 19, 2014

(54) PORTABLE LIGHT WITH SAFETY LOCK

(75) Inventor: Timothy S. Weber, Audubon, PA (US)

(73) Assignee: Streamlight, Inc., Eagleville, PA (US)

( * ) Notice: Subject to any disclaimer, the term of this patent is extended or adjusted under 35 U.S.C. 154(b) by 552 days.

(21) Appl. No.: 13/101,563

(22) Filed: May 5, 2011

(65) Prior Publication Data

US 2012/0281394 A1 Nov. 8, 2012

(51) Int. Cl.
*F21V 19/00* (2006.01)

(52) U.S. Cl.
USPC ..... 362/186; 362/202; 362/208

(58) Field of Classification Search
USPC ..... 362/186, 202, 208, 374, 206
See application file for complete search history.

(56) References Cited

U.S. PATENT DOCUMENTS

| | | | | |
|---|---|---|---|---|
| 608,109 | A | 7/1898 | Dow | |
| 1,813,755 | A * | 7/1931 | Neuner | 362/374 |
| 2,592,208 | A | 4/1952 | Stamper | |
| 2,848,598 | A | 8/1958 | Amlee | |
| 3,811,157 | A | 5/1974 | Schenk | |
| 3,836,763 | A | 9/1974 | Hoffman et al. | |
| 4,007,516 | A | 2/1977 | Couldes | |
| 4,286,311 | A | 8/1981 | Maglica | |
| 4,348,715 | A | 9/1982 | Christensen et al. | |
| 5,103,384 | A | 4/1992 | Drohan | |
| 7,651,239 | B2 | 1/2010 | Spartano et al. | |
| 7,738,229 | B2 | 6/2010 | Bayat et al. | |
| 2003/0151914 | A1 | 8/2003 | Kish et al. | |
| 2008/0068832 | A1 | 3/2008 | Spartano et al. | |
| 2010/0033963 | A1 | 2/2010 | Maglica | |
| 2010/0148697 | A1 | 6/2010 | Bayat et al. | |

OTHER PUBLICATIONS

U.S. Patent and Trademark Office, Office Action—U.S. Appl. No. 13/488,563, May 8, 2013, 11 pages.
Adaro Tecnologia, SA, "Adalit L2000" web page and pages from brochure, www.adalit.es/En/HAdalitL2000EN.html, Publicacion No. EP-DA-8/1, Emision: Agosto/ 06. Rev.0, printed Apr. 18, 2011, 2 pages.
Adaro Tecnologia, SA, "Adalit L2000-L/LB Safety Rechargeable Torch User Instructions", Publicacion No. EP-DA-8/3, Emision: Enero 08. Rev.3, date: Jul. 24, 2006, 16 pages.
Lab Safety Supply, "Bright Star® WorkSafe® Razor Zone Zero Flashlight", © 2011 GHC Specialty Brands, LLC, www.labsafety.com/bright-star-worksafe-razor-zone-zero-flashlight_24535811, 2 pages.
Global Stores Group Industrial & Safety Division, "Bright Star Razor LED Flashlights", © 2006, www.allsafetysupplies.com/bright-star-razor-LED-flashlights_p_14674, 2 pages.
Bright Star, "Product Data Sheet: Razor 3AA-cell LED Flashlight", date prior to May 5, 2011, 1 pg.
StreamLight, Inc., "Product Fact Sheet—3C Luxeon Division1/Division 2 ProPolymer® Alkaline Battery-Powered Flashlight", Document 158, Rev. Feb. 5, 2007, 1 page.
Streamlight, Inc., "ProPolymer® 2AA/4AA/3C Operating Instructions", © 2008, 4 pages.
Streamlight, Inc., "ProPolymer® 3C Lux Div 1", © 2011, 4 page.
International Searching Authority, "PCT Search Report and Written Opinion", International Application No. PCT/US12/36287, Aug. 7, 2012, 10 pages.
Pelican Products US, "Photos of MityLite 1965 LED", photos taken Apr. 12, 2012, 2 pages.
Pelican Products US, "Pelican MityLite 1965 LED", printed Apr. 12, 2012, 2 pages, www.pelicanproducts.us/p.pelican/mitylite.1965.led.flashlight.html.
Pelican Products US, "Pelican MityLite 1965 LED Instructions", © 2011, 2 pages.
Bayco Products, Ltd, "Photos of NightStick NSP-5422 Light", MFG Dec. 2010, photos taken Apr. 12, 2012, 2 pgs.
Bayco Products, Ltd, "XPP-5420 Series—80 Lumen Intrinsically Safe Flashlight That's Waterproof", printed Apr. 12, 2012, 4 pages.
Bayco Products, Ltd, "NightStick Catalog (CAT-NS-11C)", date prior to Apr. 27, 2012, pages include: cover, 1, 2, 8-11, 19, 23 and back.
Bayco Products, Ltd, "NightStick Pro Flyer (FLY-5422-10)",date prior to Apr. 27, 2012, 2 pages.
U.S. Dept. of Labor, MSHA, "Criteria for the Evaluation and Test of Intrinsically Safe Apparatus and Associated Apparatus (ACRI2001)", Nov. 4, 2008 (Third Edition), 11 pages.
Underwriters Laboratories, Inc., "Electrical Apparatus for Explosive Gas Atmospheres—Part 0: General Requirements (UL60079-0)", Aug. 15, 2005, 8 pages.
Underwriters Laboratories, Inc., "Explosive Atmospheres—Part 11: Equipment Protection by Intrinsic Safety "I" (UL60079-11)", Sep. 30, 2009, 8 pages.
Underwriters Laboratories, Inc., "Intrinsically Safe Apparatus and Associated Apparatus for Use in Class I, II, and III, Division 1, Hazardous (Classified) Locations (UL 913)", Seventh Edition, Jul. 31, 2006, 4 pages.
International Standard, "Explosive Atmospheres—Part 0: Equipment—General Requirements (IEC 60079-0)", Edition 5.0, Oct. 2007, 10 pages.
International Standard, "Electrical Apparatus for Use in the Presence of Combustible Dust—Part 0: General Requirements (IEC 61241-0)", First Edition, Jul. 2004, 7 pages.
International Standard, Explosive Atmospheres—Part 11: Equipment Protection by Intrinsic Safety "i" (IEC60079-11), Edition 6.0, Jun. 2011, 8 pages.

* cited by examiner

*Primary Examiner* — Sharon Payne
(74) *Attorney, Agent, or Firm* — Clement A. Berard, Esq.; Dann, Dorfman, Herrell & Skillman, PC

(57) ABSTRACT

A portable light or other device having a safety lock may comprise: a body having an opening; a cover for engaging and covering the opening of the body; and a lock mechanism including a lock member for engaging the body and the cover for preventing removal of the cover from the body unless the lock mechanism is released by a tool, wherein the lock member is retained on the body or on the cover when the lock mechanism is engaged and when the lock mechanism is released. The cover may be a light head or a light source.

33 Claims, 13 Drawing Sheets

FRONT VIEW

SIDE VIEW

FRONT VIEW

SIDE VIEW

SECTION B-B

PORTABLE LIGHT WITH SAFETY LOCK

The present invention relates to a portable device, e.g., a portable light and, in particular, to a portable device having a lock.

Conventional portable devices including portable lights, e.g., flashlights, typically may be disassembled relatively easily as is convenient for, e.g., replacing a discharged battery. Commonly, either a light head portion of the light or a tail cap portion thereon or both can be unscrewed from the light to gain access to the battery inside the body of the light. Certain conventional portable lights are also sealed, e.g., by gaskets and/or O-rings, so as to resist the entry of undesired substances, e.g., moisture, dirt and debris, and may be sealed to resist entry of water (if intended or likely to be underwater) and/or a hazardous fluid (if intended or likely to be used in a hazardous environment).

Hazardous environments may include, e.g., mines, refineries, repair and maintenance operations, fueling stations, storage sites, industrial and government locations where ignitable concentrations of flammable gases, vapors and/or liquids can exist, usually as a normal or expected occurrence.

Portable devices and lights intended for use in a hazardous environment often are or are required to be certified as being "safe" for use in the intended hazardous environment. Agencies and organizations such as Underwriter's Laboratory ("UL" in the United States), ATEX (Europe) and the Mine Safety and Health Administration (MSHA, part of the Department of Labor in the United States), as well as other organizations and agencies, serve as official or unofficial standard setting and certifying agencies regarding safety. One prior art approach regarding safety is to try to make a device or light that is "intrinsically safe."

An "intrinsically safe" device or light may have an electrical circuit that is intended to limit the amount of energy that can be produced so that it cannot produce a spark or thermal heat sufficient to cause fire or ignition of a flammable or combustible mixture in air at the lowest ignitable concentration. A portable device or light cannot be claimed to be "intrinsically safe" unless it has been appropriately certified for a particular hazardous condition by an appropriate certifying agency. However, internal energy limited circuitry does not prevent a user from disassembling a device or light while in a hazardous environment.

At present, one or more certifying agencies require that a device, e.g. a flashlight, cannot be certified as "intrinsically safe" or receive a certain safety rating unless it cannot be disassembled in a hazardous location, e.g. the head and/or battery compartment cover cannot be removed, without the use of a tool or a special fastener.

Applicant believes there is a need for a portable device, e.g., a light, that includes a locking arrangement that prevents disassembly without the use of a tool, and in which parts of the lock are captive against misplacement or loss.

Accordingly, a portable light or other device having a safety lock may comprise: a body having an opening; a cover for engaging and covering the opening of the body; and a lock mechanism including a lock member for engaging the body and the cover for preventing removal of the cover from the body unless the lock mechanism is released by a tool, wherein the lock member is retained on the body or on the cover when the lock mechanism is engaged and when the lock mechanism is released. The cover may be a light head or a light source.

BRIEF DESCRIPTION OF THE DRAWING

The detailed description of the preferred embodiment(s) will be more easily and better understood when read in conjunction with the FIGURES of the Drawing which include.

Figure 1:
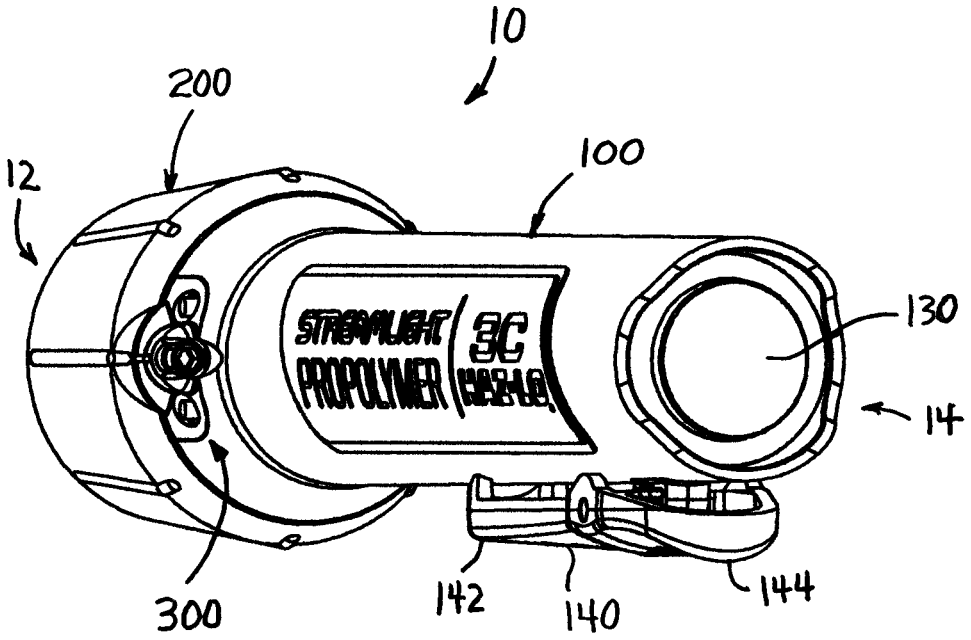
FIG. 1 is a perspective view of an example embodiment of a portable device, e.g., a light, having a lock thereon.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

An example portable device 10, e.g., a portable light 10, is described that includes an example lock arrangement 300 that precludes the unintentional disassembly of the light. In the example light, battery replacement is effected by unscrewing the light head 200 from the light body 100 to gain access to the compartment (cavity) in light body 100 wherein the battery resides. Lock mechanism 300, if engaged, prevents removal of light head 200 unless a tool is employed to release lock 300. Because a tool is required, light head 200 will not loosen and cannot be removed accidentally or unintentionally—it requires the intentional use of a tool.

Figure 2A:
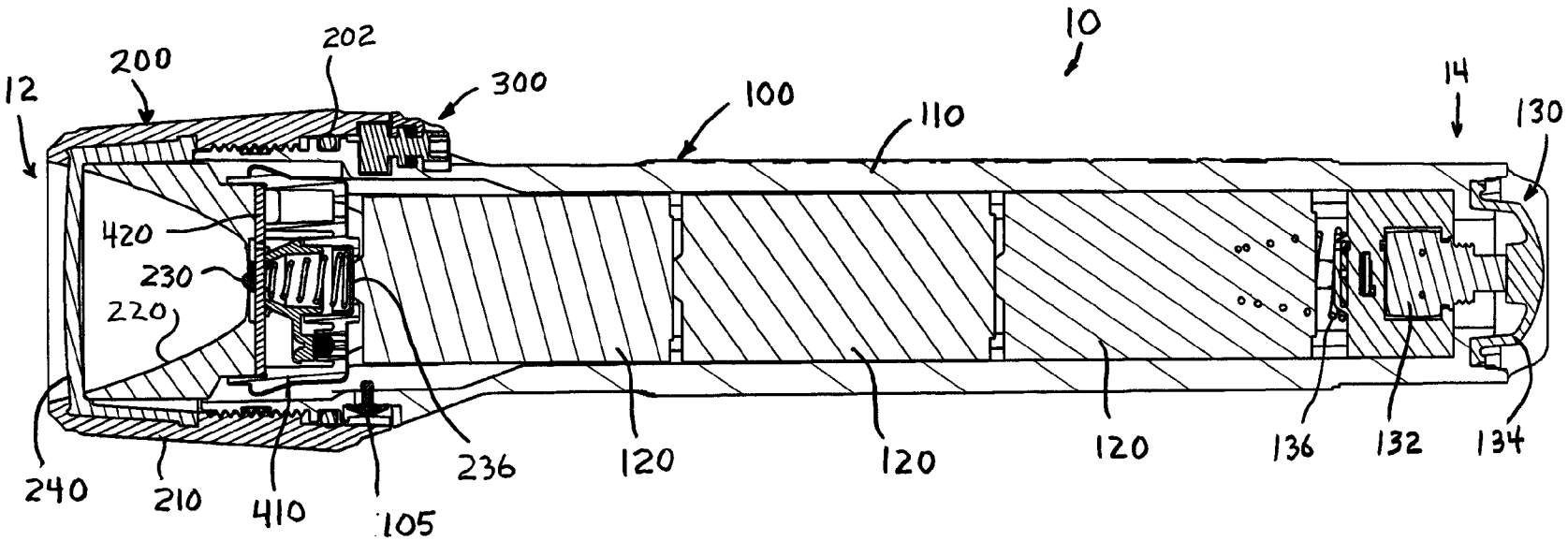
FIGS. 2A and 2B are different cross-sectional side views of the example portable light having a lock thereon of FIG. 1.
Figure 2B:
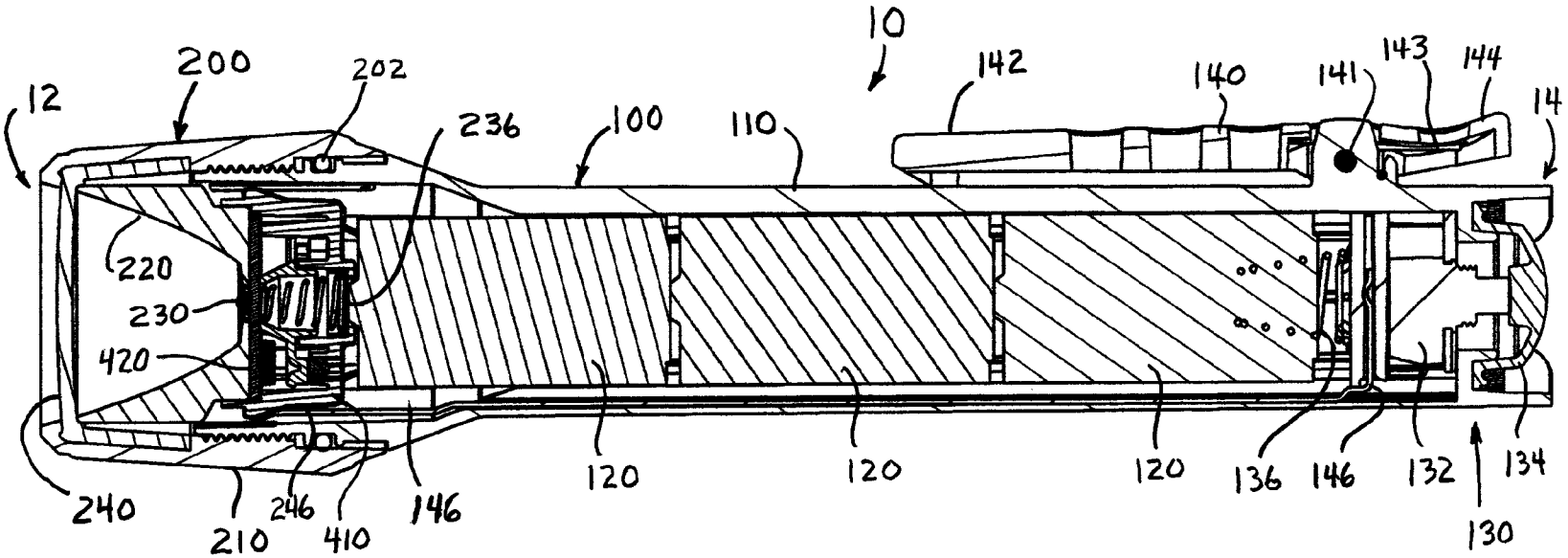

FIG. 1 is a perspective view and FIGS. 2A and 2B are cross-sectional side views of an example portable device 10, e.g., light 10, having an example lock 300 thereon. The cross-sections of FIGS. 2A and 2B are taken at about 90° rotation from each other. Portable device 10 is a flashlight 10 having a light body 100 and a light head 200 or cover 200 containing a light source 230 on a forward or head end 12 thereof. Light body 100 has a switch 130 at a rearward or tail end 14 thereof for controlling the light produced by a light source of light head 200.

Light body 100 comprises a housing 110 which has an internal cavity for receiving one or more battery cells 120 therein and has a spring-biased pivoted clip 140 for attaching light 10 to an object, such as a person, clothing, head wear, helmet, tool, equipment and the like. Clip 140 is pivotably attached to light body 100 by pivot pin 141 which passes through aligned holes through clip 140 and through a projection extending from the exterior of light housing 110. Clip 140 is biased by a spring 143 so that the elongated end 142 thereof remote from pin 141 is biased against housing 110. Clip 140 may have a loop 144 at the other end thereof so that light 10 may be provided with a wrist strap or lanyard or may be hung on an available hook, pin or post or other projection.

Light head 200 at the forward end of light 10 comprises a head housing 210 containing a reflector 220 and light source 230, e.g., a light emitting diode (LED) 230. LED 230 is located at the base of reflector 220 which has a lens 240 covering the open forward end thereof. LED 230 is preferably disposed on an electronic circuit board 420 through which heat generated by LED 230 is coupled to reflector 220 which serves as a heat sink 220. An O-ring 202 may be employed to provide a seal between housing head 210 and body housing 110. Housing 110 may have a pressure relieving vent 105 therein, e.g., disposed in a hole fluidly coupling the interior of housing 110 to the external environment.

Switch 130 at the tail end 14 of light 10 controls operation of light 10 in response to actuation or actuations by a user pressing on actuator 134. Actuator 134 is a flexible membrane or cover that extends, e.g., in a central region, to contact the actuator button of electrical switch 132 located at the rear of housing 110. Cover 134 is circular and has a peripheral ring that engages a circular groove in the rear end 14 of housing 110 so as to provide a seal at the rear end 14 of housing 110. A contact spring 136, e.g., a coil spring 136, provides electrical connection to the rear of series connected batteries 120.

A contact 236 of head 200 makes contact with the forward contact of battery 120, preferably through a central opening that has a diameter that will pass the small diameter projecting positive contact of battery 120, whereby should batteries 120 be inserted with reverse polarity, a reverse polarity voltage that might damage light source 230 and/or circuitry of circuit board 420 can not be applied thereto. In one embodiment, light 10 utilizes three batteries 120 in series, as illustrated, which batteries 120 may be C-size cells, e.g., alkaline battery cells.

Where housing 110 is electrically conductive, the circuit between the switch 130 at the rear 14 of housing 110 and head 200 may be completed by housing 110. Where housing 110 is not electrically conductive, the circuit between the switch 130 at the rear 14 of housing 110 and head 200 may be completed by an electrically conductive strip 146 extending through the battery cavity of housing 110 between switch 130 and head 200. A contact 236, which may be a spring contact 236, at the rear of head 200 provides electrical connection to the forward end of series connected batteries 120, and a ring contact 246 of head 200 may provide electrical connection to conductive housing 100 or the conductive strip 146 therein.

Light head or cover 200 is attached to light body 100 typically by a threaded engagement therebetween so that head 200 may be rotated to engage its internal thread with an external thread of housing 110, thereby to be able to be screwed onto and off of housing 110. In a conventional light, a head 200 or a cover 200 may simply be rotated to be removed from and attached to an end of housing 110. Light 10, however, does not allow such simple removal and attachment which can compromise safety, particularly in a hazardous environment.

Device or light 10 is improved over conventional devices and lights in that it includes a lock 300 that secures light head 200 or cover 200 to body 100 and in that it requires a tool to be disengaged (unlocked). In some embodiments lock 300 may require a tool to be engaged (locked) and in other embodiments lock 300 may not require a tool to be engaged (locked). Preferably, lock 300 also provides a positive indication, e.g., a visual indication, to a user that it is in the engaged (locked) or safe condition or that it is in the disengaged (unlocked) or unsafe condition.

Figure 3:
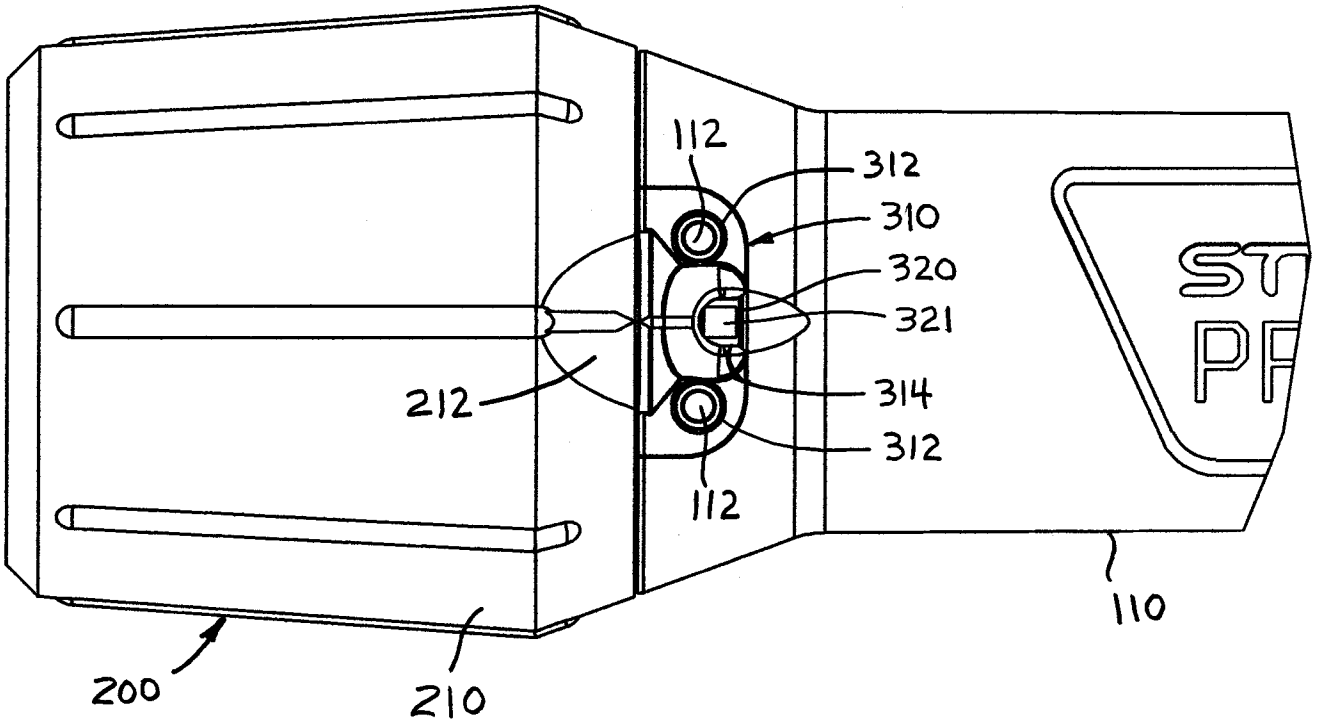
FIG. 3 is a partial view of the example light showing the example lock arrangement thereof.
Figure 4:
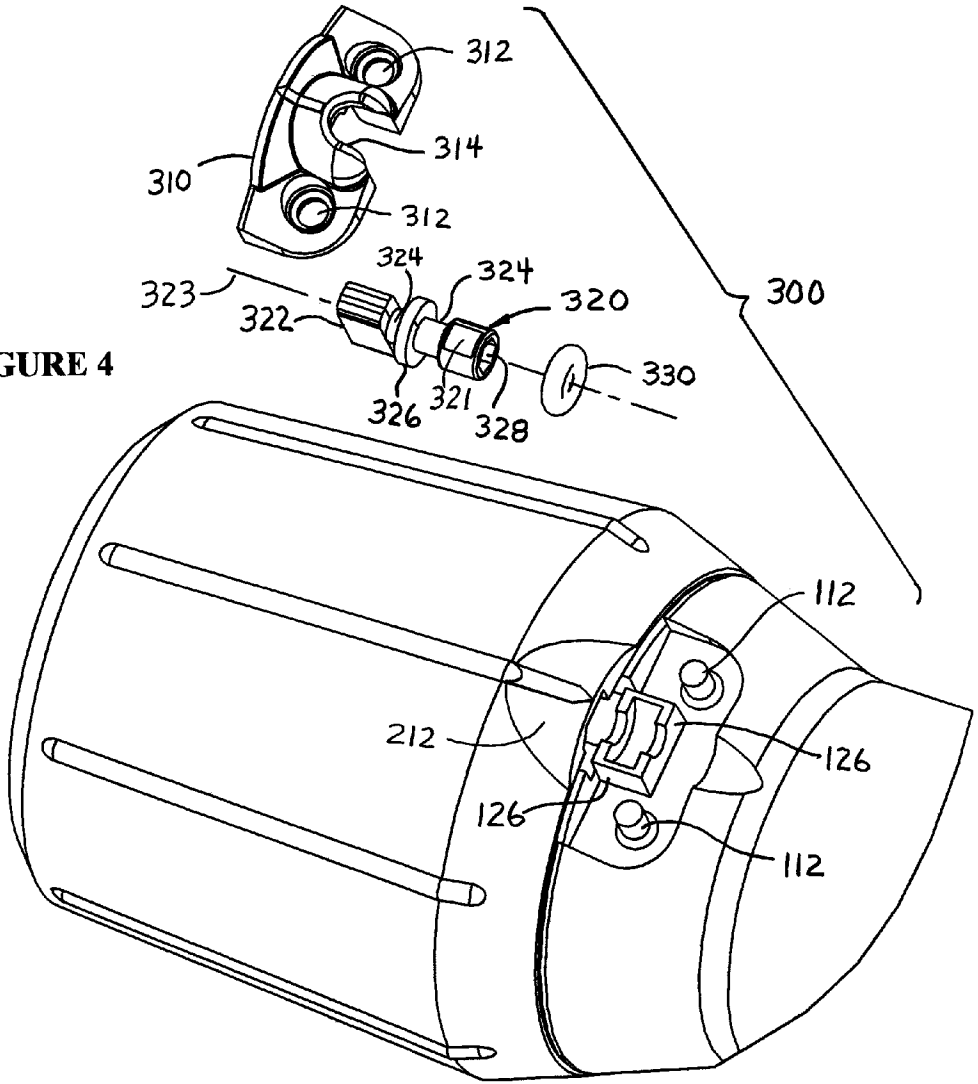
FIG. 4 is an exploded perspective view of the example lock arrangement of FIG. 3.

FIG. 3 is a partial view of the example light 10 showing the lock 300 arrangement thereof and FIG. 4 is an exploded view of lock 300 arrangement. Lock 300 comprises a locking member 320 that when locked engages both housing 110 and head housing 210 or a cover 210 to prevent rotation of head housing or cover 210 relative to housing 110 and that when unlocked disengages from one or both of head housing or cover 210 and housing 110 to permit relative rotation thereof, whereby head 200 may be removed (typically, unscrewed) from housing 110. All parts of lock 300 are captive in or on either body housing 100 or light head 200, whereby the parts of lock 300 can not be misplaced or lost.

In example lock 300 of light 10, a locking member 320 is rotatably mounted to light body housing 110 and has a lock blade 322 that extends forward so as to be covered by head housing 210 (as shown) when head 200 is fully screwed onto housing 110 of light body 100. Lock 300 includes a generally C-shaped lock cover 310 that cooperates with features of housing 110 to provide a seat 126, 316 in which lock member 320 is rotatable relative to housing 110 as described below. Cover 310 is placed against housing 110 after lock member 320 is seated therebetween and is secured thereto, e.g., preferably by one or more posts 112 of housing 110 that extend through one or more holes 312 of cover 310 and are then thermally heated and compressed to permanently heat stake cover 310 to housing 110. Cover 310 has a raised protrusion to provide space for seating lock member 320 and head housing 210 has a corresponding protrusion to provide space for a recess 212 for receiving a part 322, e.g., a lock blade 322, of lock member 320 therein.

Lock member 320 comprises a central shaft 324 that has a lock blade 322 at one end thereof and has a tool receiving feature 328 at the other end thereof. Blade 322 is a generally rectangular member that extends radially from shaft 324 in at least one direction so as to sweep an arc when shaft 324 is rotated. In the example shown, blade 322 extends radially from shaft 322 in both directions, thereby to extend outwardly from housing 110 to engage head housing 210 and inwardly to engage light housing 110. Lock blade 322 may have beveled, chamfered and/or rounded edges for facilitating its rotation when in lock 300.

Tool receiving feature 328 or tool interface 328 may be, e.g., a recess into which a tool may be inserted for rotating lock member 320 about the central axis 323 of shaft 324 thereof, or may be a projection 328 onto which a tool may be placed for rotating lock member 320. While tool interface 328 may have any convenient shape, and may have a recess and/or a projection, in one preferred embodiment tool socket 328 has a hexagonal cross-sectional shape for receiving a tool having a hexagonal cross-sectional shape.

Alternatively, tool interface 328 may have a relatively simple or common shape, such as a slot for receiving a flat blade screwdriver or a cruciform shape (a cross "+" shape) for receiving a Philip's head or cross head screwdriver, or socket 328 may have a more complex shape, e.g., such as a ribbed shape for receiving a Torx® driver tool or another less common or even non-standard tool, and/or may be a projection for receiving similar a standard and/or non-standard tool.

Figure 5A:
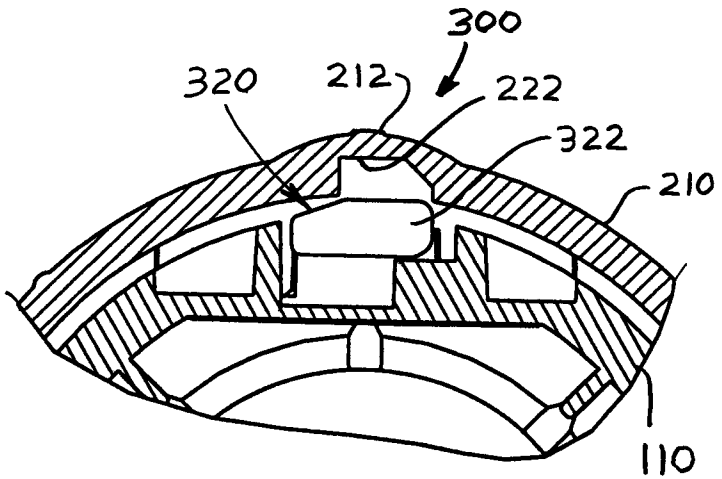
FIGS. 5A and 5B are a front view and a side cross-sectional view, respectively, of the portion of the example light showing the example lock in an unlocked or disengaged condition.
Figure 5B:
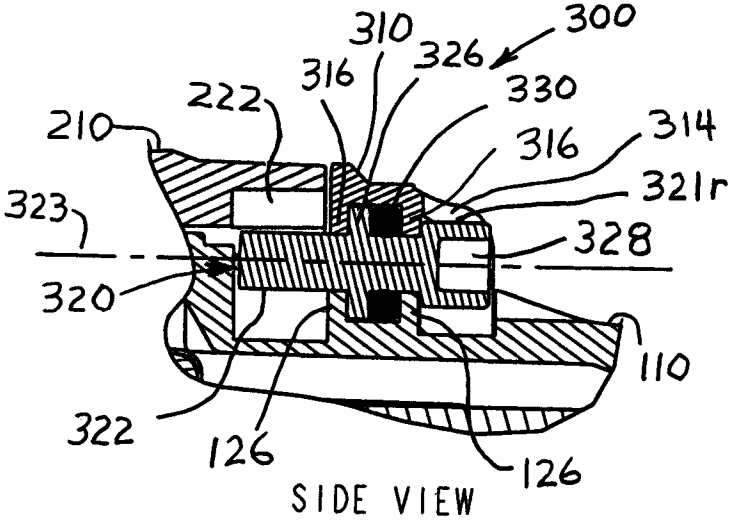
Figure 6A:
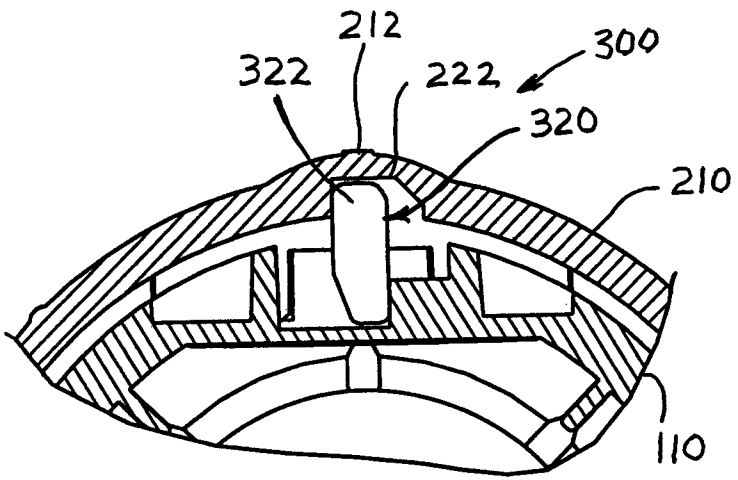
FIGS. 6A and 6B are a front view and a side cross-sectional view, respectively, of the portion of the example light showing the example lock in a locked or engaged condition.
Figure 6B:
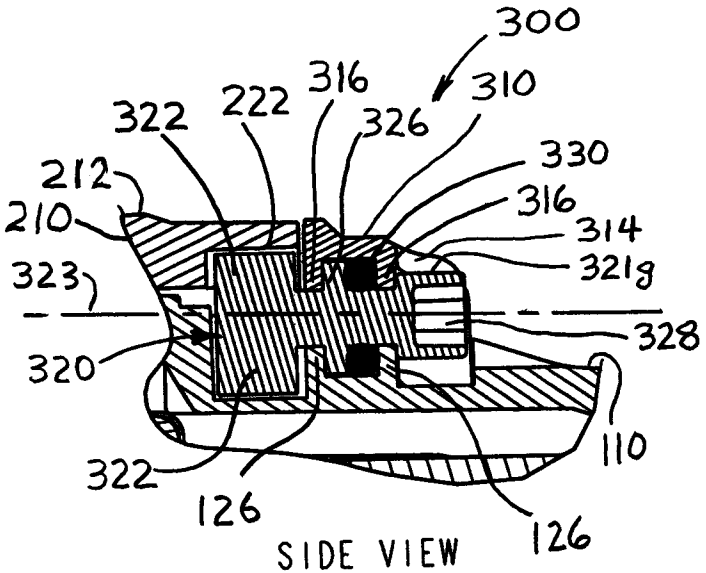

Lock member 320 includes a raised feature 326 for engaging a seat formed by complementary features 126, 316 on the exterior of light housing 110 and on the interior of lock cover 310, as may also be seen in FIGS. 5B and 6B. Feature 326 may be a circular ridge or flange 326 on shaft 324 of lock member 320 and features 126, 316 may be spaced apart walls 126 on light housing 110 and spaced apart walls 316 on cover 310 which align when cover 310 is attached to housing 110, and which may also have curved or semicircular recesses for receiving shaft 324. Preferably, walls 126, 316 allow for rotation of shaft 324 therebetween and are spaced apart more than the thickness of circular flange 326 so as to allow for rotation of shaft 324. More preferably, walls 126, 316 are spaced apart sufficiently to also allow space for a friction providing member so that lock member 320 will remain in the position to which it is rotated when subjected to handling and vibration. A preferred friction member 330 is an O-ring 330 that resides on shaft 324 of lock member 320 adjacent ring flange 326.

Lock cover 310 has an opening 314 out of which shaft 324 of lock member 320 extends for tool feature 328 thereof being positioned to receive a tool for locking and unlocking head 200 and preferably for exposing a portion of lock member 320 that has an indicator 321 of the lock status (condition) thereon. Indicator 321 preferably comprises two different indicator portions corresponding to locked and unlocked conditions. Indicator 321 may be a colored region on the external surface of lock member 321. In one example, one indicator region 321 g is color green indicating a locked or safe condition, e.g., when lock 300 engages head housing or cover 210, and one indicator region 321*r* is color red indicating an unlocked or open unsafe condition, e.g., when lock 300 is not engaging head housing or cover 210. Where light 10 is a light intended for use in a hazardous environment, a green or safe indicator 321 g indicates that light 10 may be used in an intended hazardous location and a red or unsafe indicator 321*r* indicates that light 10 should not be used in a hazardous location.

In the arrangement of cover 310 and lock member 320 illustrated, a tool is required to engage lock mechanism 300 and to release lock mechanism 300. Further and optionally therein, a red indicator 321*r* is located on at the tool socket 328 end of shaft 324 at approximately the same angular location as one flat side of lock blade 322 so as to be visible in opening 314 of cover 310 when lock 300 is disengaged (open) and green indicator 321*g* is located about 90° radially around therefrom so as to be visible in opening 314 of cover 310 when lock 300 is engaged (closed).

FIGS. 5A and 5B are a front view and a side cross-sectional view, respectively of the portion of the example light 10 showing the lock 300 in an unlocked (i.e. a disengaged or open) condition. In the disengaged position, lock member 320 is rotated so as to rotate blade 322 to be approximately tangential to the exterior surfaces of body housing 110 and head housing 210. In that orientation, lock blade 320 does not engage lock recess 222 of head housing 210, whereby head housing 210 is not restricted by lock 300 from being rotated relative to body housing 110, and so may be removed therefrom.

Lock 300 is locked or engaged by using an appropriate tool to rotate lock member 320 about 90° clockwise so that lock blade 320 thereof rotates into recess 222 of head housing 210 as below. Lock member 320 is held captive to or is retained to light body housing 110 by cover 310 being mounted on light body housing 110, and so no element of lock mechanism 300 is free of light 10 and so can not be misplaced or lost.

FIGS. 6A and 6B are a front view and a side cross-sectional view, respectively, of the portion of the example light 10 showing the lock 300 in a locked condition. In the locked or engaged position, lock member 320 is rotated so as to rotate blade 322 to be approximately radial to body housing 110 and head housing 210. In that orientation, lock blade 320 extends radially outward from body housing 110 to engage lock recess 222 of head housing 210, whereby head housing 210 is restricted by lock member 320 of lock 300 from being rotated relative to body housing 110, and so may not be removed therefrom.

Lock 300 is unlocked or disengaged by using an appropriate tool to rotate lock member 320 about 90° counter-clockwise so that lock blade 320 thereof rotates out of recess 222 of head housing 210 as above.

Figure 7A:
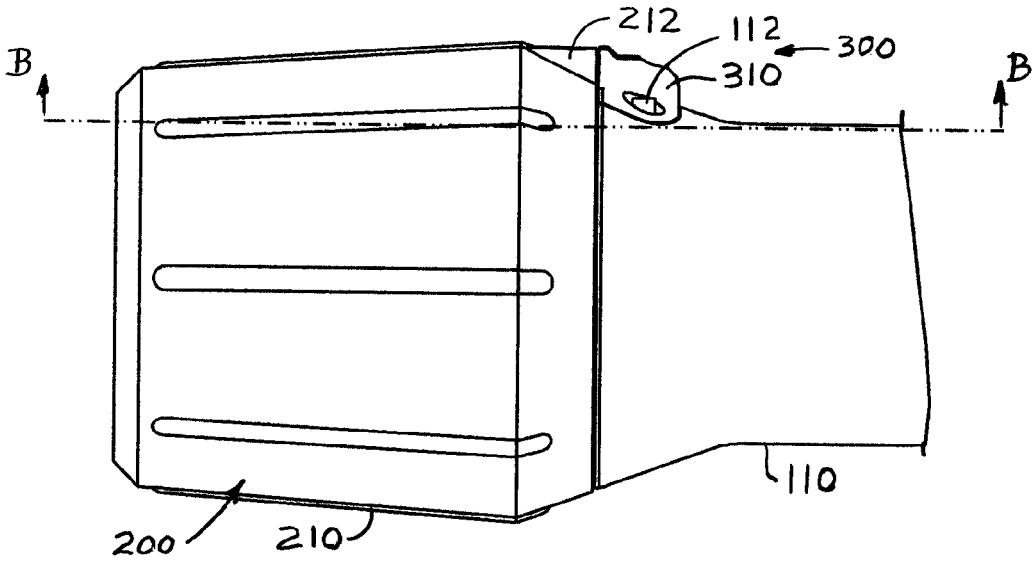
FIG. 7A is a side view of the forward end of the example light.
Figure 7B:
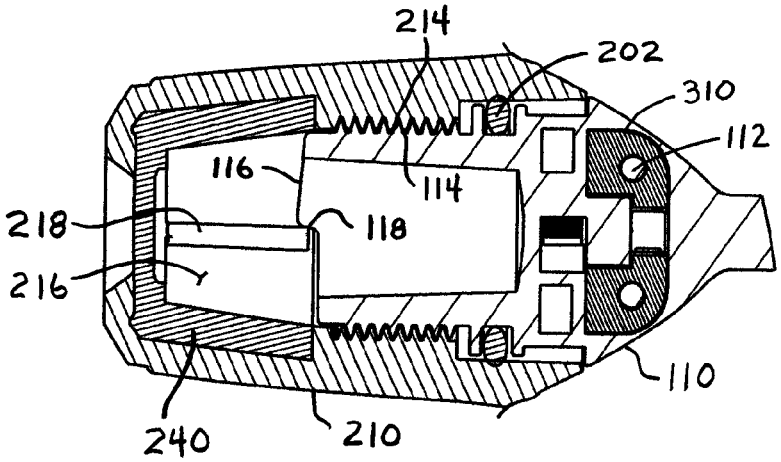
FIG. 7B is a cross-sectional view thereof showing an alignment feature thereof.
Figure 7C:
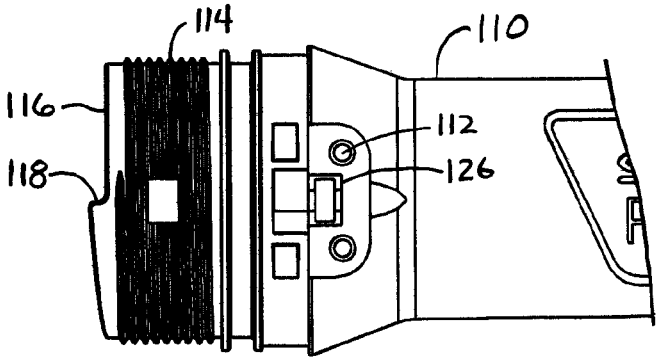
FIG. 7C is a side view of the body housing thereof showing the alignment feature thereon.

FIG. 7A is a side view of the forward end 12 of the example light 10, FIG. 7B is a cross-sectional view thereof showing an alignment feature 116-118, 216-218 thereof, and FIG. 7C is a side view of the body housing 110 thereof showing the alignment feature 116, 118 thereon. Light head 200 and light body 100 preferably have corresponding features, e.g., projections 118, 218, that engage each other to prevent further rotation of head 200 relative to light body 100 when light head 200 is screwed onto light body 100 to a position whereat the parts of lock 300 of light body 100 are aligned with the parts of lock 300 of light head 200 so that lock 300 may be engaged (locked) and disengaged (released).

Light head 200 typically has internal threads 214 in head housing 210 by which head housing 210 threads onto the external threads 114 at the forward end 12 of light body housing 110. Body housing 110 may have at its circular forward edge 116 a projection 118, e.g., a shoulder 118, that is located at predetermined radial angle relative to lock 300, e.g., may be at about the same radial angle as is the seat 126 for lock member 320.

Light head housing 210 may have a projection 218 on the internal cylindrical surface 216 thereof that extends sufficiently to contact projection 118 at the forward end 116 of light body housing 110 when light head housing 210 is screwed thereon to a position whereat lock 300 can be engaged. Specifically, projection 218 may be a longitudinal ridge or shoulder 218 extending radially inward from the inner surface 216 of head housing 210 in a location and at a predetermined radial angle relative to projection 212 and recess 222 therein, e.g., may be at about the same radial angle as is the projection 212 that defines recess seat 222 for receiving blade 322 of lock member 320 to engage lock 300.

Engaging feature 118 may be defined by a notch or shoulder 118 or other feature near the circular edge 116 at the forward end of housing 110, or any other feature thereat which is at a radial angle and a location to engage a corresponding feature of head 200. Likewise, engaging feature 218 may be defined by a projection, shoulder and/or recess 118 or other feature near the inner surface 216 of light housing 210, or any other feature thereat which is at a radial angle and a location to engage a corresponding feature of light housing 100.

While an alignment feature 118, 218 is a convenient and helpful feature, it is not necessary to the proper operation of lock 300.

Figure 8:
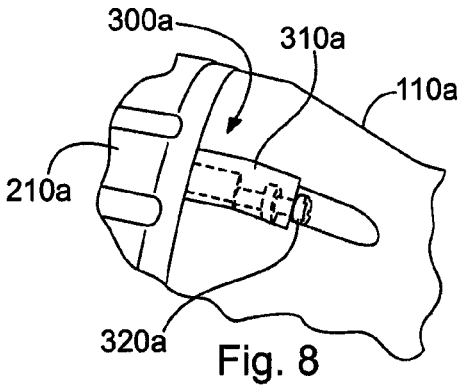
FIG. 8 is a perspective view of an alternative example lock arrangement.
Figure 8B:
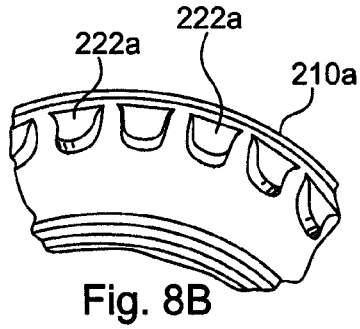
FIG. 8A is a cross-sectional view thereof and FIG. 8B is an interior perspective view of an example light head therefor.
Figure 8A:
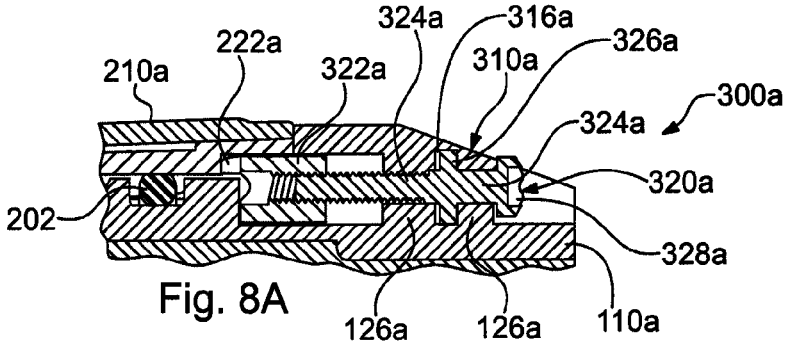

FIG. 8 is a perspective view of an alternative example lock arrangement 300*a*, FIG. 8A is a cross-sectional view thereof and FIG. 8B is an interior perspective view of an example light head housing 210*a* therefor. In lock arrangement 300*a*, a tool is required to engage lock mechanism 300*a* and to release lock mechanism 300*a*. Lock member 320*a* and blade 322*a* are held captive to or are retained to light body housing 110*a* by cover 310*a* being mounted on light body housing 110*a*, and so no element of lock mechanism 300*a* is free of light 10 and so can not be misplaced or lost.

Lock arrangement 300*a* includes lock member 320*a* rotatable in seat 126*a* in light housing 110*a* and retained therein by cover 310*a*. Lock member 320*a* has a shaft 324*a* extending substantially the length thereof with flange ring 326*a* that is rotatably seated in seat 126*a* of housing 110*a* and in groove 316*a* in the underside of cover 310*a*, and has receptacle 328*a* at its exposed end for receiving a tool by which lock member 320*a* may be rotated. Head housing 210*a* has one or more ribs defining one or more recesses 222*a*, and preferably a plurality of recesses 222*a*, around the rearward end thereof so as to provide a feature or features to which blade 322*a* of lock member 320*a* can engage to lock the lock 300*a*.

The end of shaft 324*a* is threaded to threadingly engage lock blade 322*a* so that when lock member 320*a* is rotated in one direction, blade 322*a* is moved away from light head housing 210*a* (e.g., longitudinally or axially relative to housing 110*a*) so as to disengage from one of recesses 222*a* therein, thereby to release lock 300*a* enabling head 210*a* to be removed from light body 110*a*. When lock member 320*a* is rotated in the other direction, blade 322*a* is moved towards light head housing 210*a* so as to engage one of recesses 222*a* therein, thereby to engage lock 300*a* to prevent head 210*a* from being removed from light body 110*a*, at least without a tool being used to rotate lock member 320*a* in the first direction to release lock 300*a*.

While recesses 222*a* may be castellated, e.g., they may have relatively flat ends between the recesses, the ends between recesses may be narrowed and the recesses 222*a* may be tapered so as to facilitate lock blade 322*a* entering into one of recesses 222*a*. Further, the forward end of lock blade 322*a* may be rounded or tapered so as to facilitate its entering a recess 222*a*.

Figure 9:
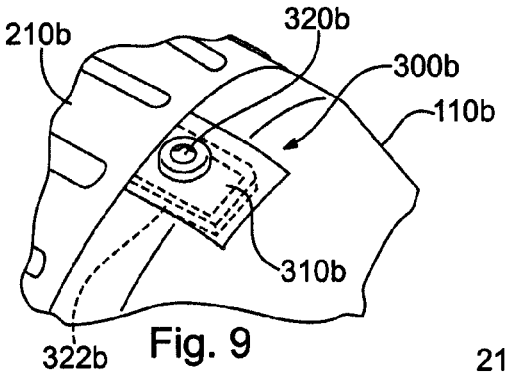
FIG. 9 is a perspective view of an alternative example lock arrangement.
Figure 9A:
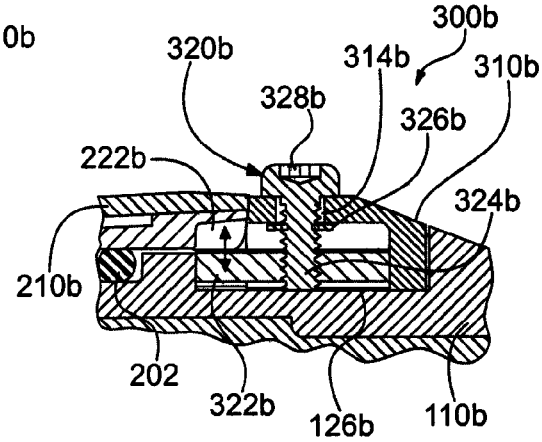
FIG. 9A is a cross-sectional view thereof and FIG. 9B is an exterior perspective view of an example housing therefor.
Figure 9B:
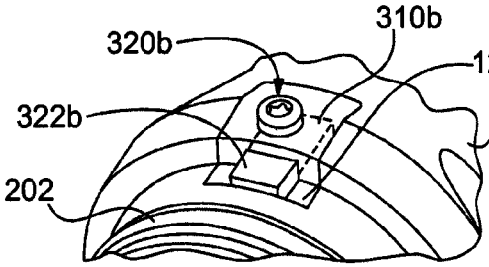

FIG. 9 is a perspective view of an alternative example lock arrangement 300*b*, FIG. 9A is a cross-sectional view thereof and FIG. 9B is an exterior perspective view of an example housing 110*b* therefor. In lock arrangement 300*b*, a tool is required to engage lock mechanism 300*b* and to release lock mechanism 300*b*. Lock member 320*b* is held captive to or is retained to cover 310*b* by retainer 326*b* and by cover 310*b* being mounted on light body housing 110*b*, and so no element of lock mechanism 300*b* is free of light 10 and so can not be misplaced or lost.

Lock arrangement 300*b* includes lock member 320*b* rotatable in an opening 314*b* in cover 310*b* which is retained in seat 126*b* of light housing 110*b*. Lock member 320*b* has a shaft 324*b* extending substantially the length thereof with retaining ring 326*b*, e.g., an E-ring 326*b*, that is seated thereon, e.g., in a groove therein, to retain lock member 320*b* in opening 314*b* in cover 310*b*. Lock member 320*b* has receptacle 328*b* at its exposed end for receiving a tool by which lock member 320*b* may be rotated. Head housing 210*b* has one or more recesses 222*b* around the rearward end thereof so as to provide features to which blade 322*b* of lock member 320*b* can engage to lock the lock 300*b*.

The end of shaft 324*b* is threaded to threadingly engage lock blade 322*b* so that when lock member 320*b* is rotated in one direction, blade 322*b* is moved away from seat 126*b* of light housing 110*b* (e.g., radially relative to housing 110*b*) into recess 222*b* so as to engage recess 222*b* in head housing 210*b*, thereby to engage lock 300*b* to prevent head 210*b* from being removed from light body 110*b*, at least without a tool being used to rotate lock member 320*b* in the opposite direction to release lock 300*b*. When lock member 320*b* is rotated in the opposite direction, blade 322*b* is moved away from light head housing 210*b* into seat 126*b* of housing 110*b* so as to disengage recess 222*b* in head housing 210*b*, thereby to release lock 300*b* to allow head 210*b* to be removed from light body 110*b*.

Plural recesses 222*b* may be provided with the ridges between recesses 222*b* tapered so as to facilitate lock blade 322*b* moving into one of recesses 222*b*. Further, the forward (upper) end of lock blade 322*b* may be rounded or tapered so as to facilitate its entering a recess 222*b*.

Figure 10:
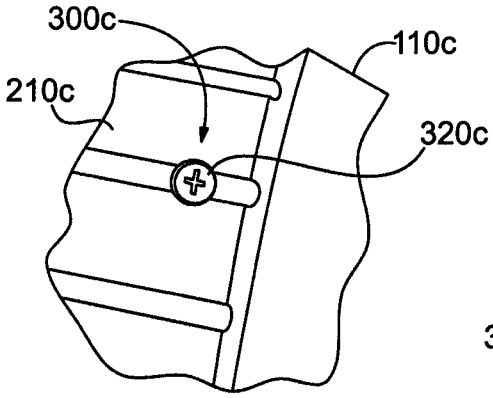
FIG. 10 is a perspective view of an alternative example lock arrangement.
Figure 10A:
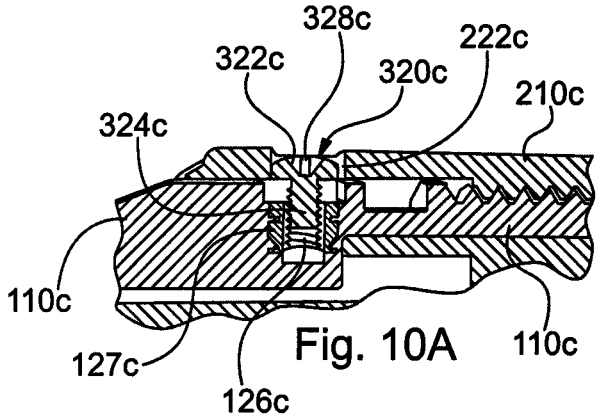
FIG. 10A is a cross-sectional view thereof.

FIG. 10 is a perspective view of an alternative example lock arrangement 300*c*, and FIG. 10A is a cross-sectional view thereof. Lock arrangement 300*c* includes lock member 320*c* rotatable in an opening 222*c* in housing 210*c* which is retained in light housing 110*c*, e.g., by a threaded insert 127*c* therein. In lock arrangement 300*c*, a tool is required to engage lock mechanism 300*c* and to release lock mechanism 300*c*. Lock member 320*c* is preferably held captive to or are retained by insert 127*c*, e.g., by a retainer clip or distorted thread, and insert 127*c* is embedded in light body housing 110*c*, and so no element of lock mechanism 300*c* is free of light 10 and so can not be misplaced or lost.

Lock member 320*c* has a shaft 324*c* extending substantially the length thereof with threads at the end thereof engaging threaded insert 127*c*, and may optionally be retained therein, e.g., by a retainer or by deformed threads and the like. Lock member 320*c* has receptacle 328*c* at its exposed end for receiving a tool by which lock member 320*c* may be rotated. Receptacle 328*c* may be a slot or a cross-slot for receiving a flat bladed tool (e.g., screwdriver) or a cross-shaped (e.g., Philips head") tool. Head housing 210*c* has one or more recesses 222*c*, e.g., openings 222*c*, near the rearward end thereof so as to provide features to which head 322*c* of lock member 320*c* can engage to lock the lock 300*c*. Thus, head 322*c* provides the lock blade 322*c* for lock 320*c*. Insert 127*c* is optional, but preferred, and may be retained in housing 110*c* by a press fit, by ribs or barbs, by adhesive, by heat staking, by welding or by any other suitable manner.

The end of shaft 324*c* is threaded to threadingly engage insert 127*c* so that when lock member 320*c* is rotated in one direction, head 322*c* thereof is moved away from seat 126*c* of light housing 110*c* (e.g., radially outward relative to housing 110*c*) into recess 222*c* of housing 210*c* so as to engage recess opening 222*c* in head housing 210*c*, thereby to engage lock 300*c* to prevent head 210*c* from being removed from light body 110*c*, at least without a tool being used to rotate lock member 320*c* in the opposite direction to release lock 300*c*. When lock member 320*c* is rotated in the opposite direction, head 322*c* is moved away from light head housing 210*c* (e.g., radially inward) into seat 126*c* of housing 110*c* so as to disengage recess opening 222*c* in head housing 210*c*, thereby to release lock 300*c* to allow head 210*c* to be removed from light body 110*c*.

Plural recesses 222*c* may be provided, and may be tapered so as to facilitate lock blade 322*c* entering into one of recesses 222*c*. Further, the head 322*c* of lock member 320*c* is preferably rounded or tapered so as to facilitate its entering a recess 222*c*.

Figure 11:
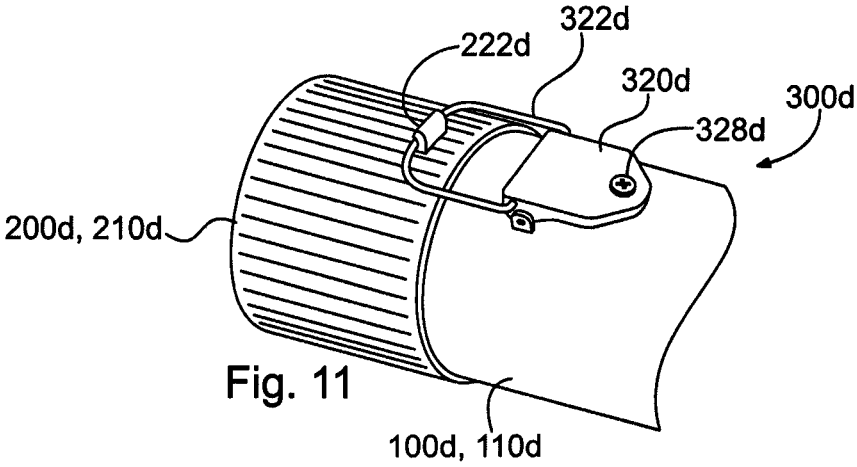
FIG. 11 is a perspective view and FIG. 11A is a cross-sectional view of an alternative example lock arrangement.
Figure 11A:
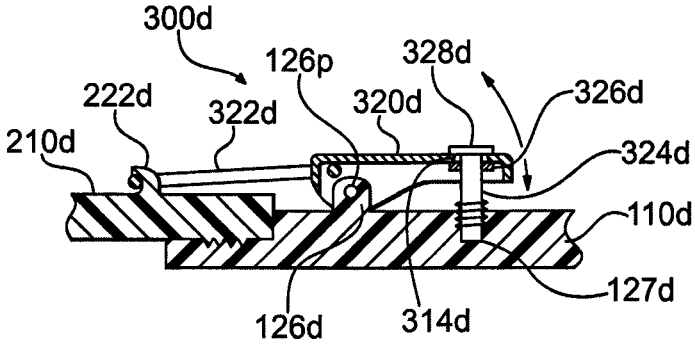

FIG. 11 is a perspective view and FIG. 11A is a cross-sectional view of an alternative example lock arrangement 300*d*. Lock arrangement 300*d* includes a pivoting latch arrangement. Therein, light head housing 210*d* preferably has a projection 222*d* or locking boss 222*d* extending therefrom over which a latch clip or loop 322*d*, e.g., a metal clip or loop 322*d*, may be placed when head 210*d* is fully threaded onto the forward end of light body housing 110*d*. Clip or loop 322*d* is pivotably attached to latch plate 320*d* which is pivotably mounted to a projection or boss 126*d* of light housing 110*d*, e.g., by a pin or rod 126*p*.

To release lock 300*d*, the end of latch plate 320*d* is moved away from light housing 110*d* to release lock 300*d*, e.g., raising latch plate 320*d* causes the pivot point for clip 322*d* to move forward thereby to move clip 322*d* forward to release clip 322*d* from locking boss 222*d* so that clip 322*d* may be lifted off locking boss 222*d*, thereby freeing head housing 210*d* for being rotated and removed from light housing 110*d*.

To engage lock 300*d*, head housing 210*d* is threaded onto light housing 110*d* so that locking boss 222*d* becomes positioned opposite and aligned with latch plate 320*d*. Clip 322*d* may be placed over locking boss 222*d*, and when the end of latch palate 320*d* is moved from a raised position toward light housing 110*d* to engage lock 300*d*, e.g., so moving latch plate 320*d* causes the pivot point for clip 322*d* to move rearward thereby to move clip 322*d* rearward to retain clip 322*d* on locking boss 222*d*, thereby restricting head housing 210*d* from being rotated and removed from light housing 110*d*.

Latch plate 320*d* has an opening therein in which is disposed a screw 324*d* the threaded shaft of which extends toward light housing 110*d* for engaging a threaded hole 127*d* therein. With latch plate 320*d* in the closed or locked position adjacent housing 110*d*, screw 324*d* may be rotated by a tool placed into tool socket 328*d* so as to advance into hole 127*d* of light housing 110*d* thereby to secure latch plate 320*d* in the locked position and to prevent lock 300*d* from being released or unlocked without use of a tool. Lock 300*d* may be released by using the tool to rotate screw 324*d* in the other direction so that it comes free of hole 127*d* thereby to permit latch plate 320*d* to be moved away from housing 110*d* to release lock 300*d*.

Preferably, screw 324*d* is held captive in an opening 314*d* in lock member 320*d*, e.g., by a clip or E-ring 326*d*, or by an un-threaded (smooth) neck, so that it does not become lost. From this location, the head 328*d* of screw 324*d* may be rotated causing screw 324*d* to become threaded into or unthreaded from threaded hole or insert 127*d* when lock member 320*d* is in the locking position, thereby to engage or disengage lock 300*d*.

E-ring 326*d* is installed on shaft 324*d* after shaft 324*d* is inserted into or threaded through hole 314*d*, either before or after latch plate 320*d* is attached to housing 110*d*. Screw 324*d* of lock member 320*d* has one or more receptacles 328*d* at its exposed end for receiving a tool by which screw 324*d* may be rotated. One example receptacle 328*d* includes a pair of spaced apart circular recesses for receiving a tool having a corresponding pair of extended pins.

In lock arrangement 300*d*, a tool is required to engage lock mechanism 300*a* and to release lock mechanism 300*d*. Lock member 324*d*-328*d* is held captive to or are retained to lock member 320*d* by retainer clip 326*d* and to light body 110*d* by lock member 320*d* being mounted on light body housing 110*d*, and so no element of lock mechanism 300*d* is free of light 10 and so can not be misplaced or lost.

Figure 12A:
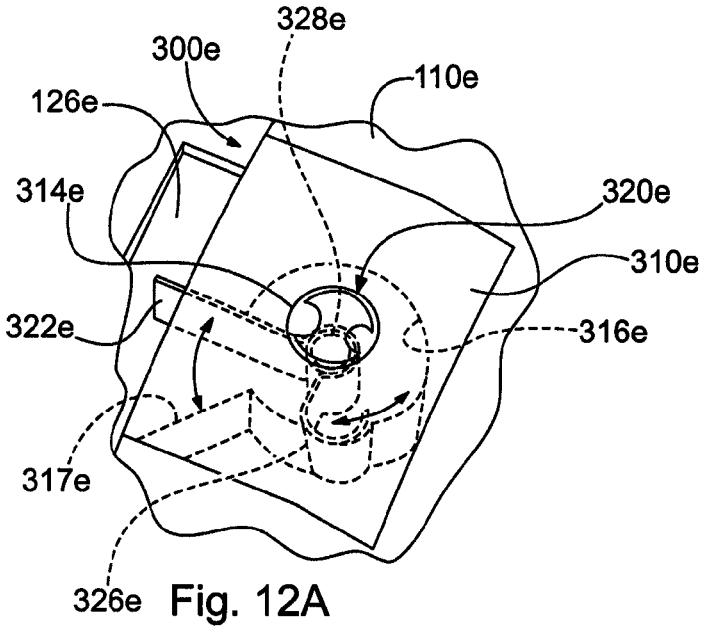
FIGS. 12A and 12B are perspective views of an alternative example lock arrangement in the engaged and released conditions, respectively.
Figure 12B:
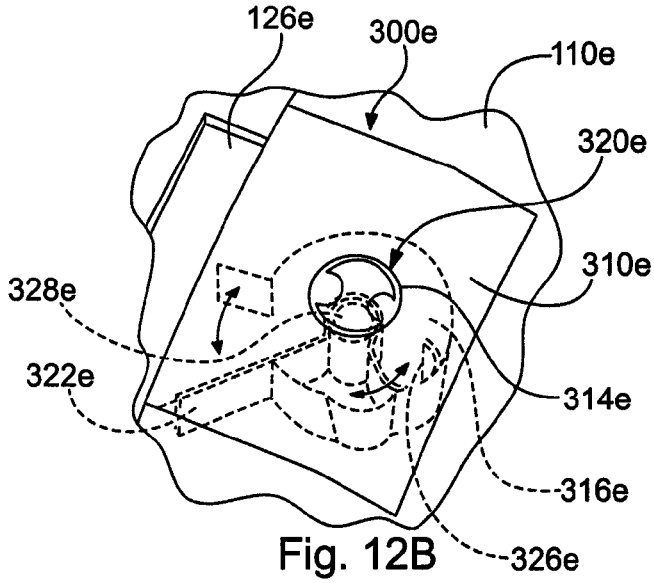
Figure 12C:
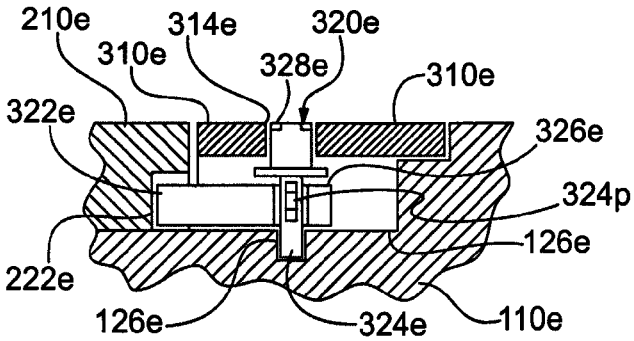
FIG. 12C is a cross-sectional view thereof.

FIGS. 12A and 12B are perspective views of an alternative example lock arrangement 300*e* in the engaged and released conditions, respectively, and FIG. 12C is a cross-sectional view thereof. Lock 300*e* preferably is a "ratcheting" type of lock which can lock automatically as head housing 210*e* is placed onto housing 110*e*, e.g., without the need of a tool to lock the lock 300*e*. While a head housing 210*e* is not shown in these FIGURES, head housing 210*e* may be similar to head housings 210*a*, 210*b* and/or 210*d* and may have recesses, ridges and/or notches 222*e* similar to recesses, ridges and notches 222*a*, 222*b* and/or 222*d* of head housings 210*a*, 210*b* and/or 210*d*.

Light housing 110*e* has a seat 126*e* therein to receive cover 310*e*, and lock member 320*e* and flat spring 326*e* are retained in seat 126*e* by cover 310*e*. Lock member spring 326*e* has at one end a longer straight portion 322*e* which provides a lock blade 322*e* that engages one or more notches or ridges or recesses 222*e* in the end of a head cover (210*e*; not shown, but similar to those 210*a*, 210*d* of head housing 210*a* or 210*d*). Lock member spring 326*e* has at its other end a curved portion 326*e* that rotates within seat 126*e* of housing 110*e* to engage raised and recessed regions of the side wall thereof which provide positional detents, e.g., for lock member spring 326*e* to be in an engaging position and in a released position. Lock member 320*e* has a curved central portion or shaft 324*e* that includes a projection 324*p* for engaging an opening or feature of curved spring 326*e* for lock member 320*e* rotating spring 320*e* about an axis that is radial to housing 110*e* for engaging and releasing lock 300*e*. Knob and receptacle 328*e* of lock member 320*e* is accessible to a tool and resides rotatably in opening 314*e* of cover 310*e*. Knob 328*e* may be a separate piece from spring 326*e* and is connected to spring 320*e* by shaft 324*e* and projection 324*p* fitting into a central loop thereof.

When lock 300*e* is engaged, straight end 322*e* of lock member spring 320*e* extends through a generally trapezoidal passage 317*e* of cover 310*e* and is biased by its spring action against one end of the rectangular end of passage 317*e*, e.g., parallel to the longitudinal axis of housing 110*e*, as in FIG. 12A. Since blade 322*e* is of fixed length, when lock member 320*e* is rotated about the axis of knob and receptacle 328*e*, blade 322*e* traces a circular arc and so extends less until it is within trapezoidal passage 317*e*, e.g., near the wall angled towards a corner of cover 310*e*, as in FIG. 12B.

In the position of FIG. 12A, threading head housing 210*e* onto light housing 110*e* (e.g., by clockwise rotation) causes ridges 222*e* at the end of housing 210*e* to engage and deflect spring blade 322*e* along the rectangular end of passage 317*e* until the tip of blade 322*e* has moved sufficiently rearward to ride over the ridge 222*e* and to return to the illustrated position ready to engage the next ridge 222*e*, thereby to ratchet as head housing 210*e* is placed on housing 110*e*. Head housing 210*e* cannot be rotated in the reverse direction (e.g., counter clockwise) because ridges or notches 222*e* thereon engage blade 322*e* and press it against the end of the opening of passage 317*e*, thereby to prevent reverse rotation of head housing 210*e* which is thus locked on housing 110*e*. Thus, lock 300*e* can engage automatically by the ratcheting action of locking member spring 320*e*.

To release lock 300*e*, knob and receptacle 328*e* is rotated counter clockwise by a tool engaging the pair of semi-circular recesses (receptacles) therein to move lock member spring 320*e* to the position shown in FIG. 12B wherein blade 322*e* is within trapezoidal passage 317*e* and does not engage ridges or notches of head housing 210*e*, and so lock 300*e* is released. Lock member 320*e* may be retained in this position by rotational pressure maintained on knob and receptacle 328*e* against its own bias tending to return blade 322*e* to the projecting engaging position, or by a detent action between spring end 326*e* and the side wall of seat 316*e*.

Plural recesses 222*e* may be provided in light head 210*e* and may be castellated, and the sides of recesses 222*e* may be angled or tapered so as to facilitate lock blade 322*e* entering into one of recesses 222*e*. In lock arrangement 300*e*, lock member 320*e* and blade 322*e* are held captive to or are retained to light body housing 110*e* by cover 310*e* being mounted on light body housing 110*e*, and so no element of lock mechanism 300*e* is free of light 10 and so can not be misplaced or lost.

Figure 13:
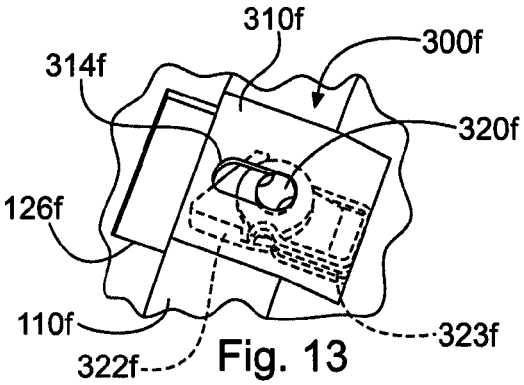
FIG. 13 is a perspective view of an alternative example lock arrangement.
Figure 13A:
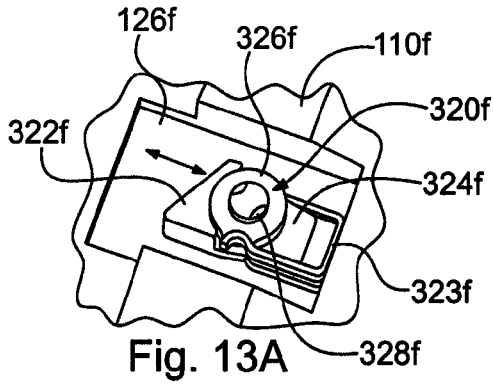
FIGS. 13A and 13B are perspective views thereof in the engaged and released conditions, respectively, with the cover removed.
Figure 13B:
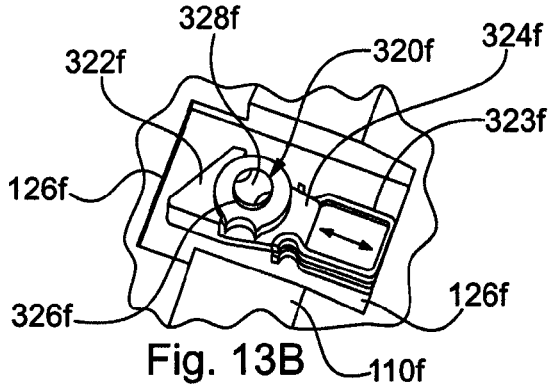

FIG. 13 is a perspective view of an alternative example lock arrangement 300*f*, and FIGS. 13A and 13B are perspective views thereof in the engaged and released conditions, respectively, with the cover 310*f* removed. Cover 310*f* is shown as being removed in FIGS. 13A and 13B so that the interior of lock arrangement 300*f* may be seen more clearly. Cover 310*f* resides in seat 126*f* of housing 110*f* and has an elongated opening 314*f* therein for applying force to receptacle 328*f* of lock member 320*f* to slide lock member 320*f* towards or away from head housing 210*f*. While a head housing 210*f* is not shown in these FIGURES, head housing 210*f* may be similar to head housings 210*a*, 210*b* and/or 210*d* and may have recesses, ridges and/or notches 222*f* similar to recesses, ridges and notches 222*a*, 222*b* and/or 222*d* of head housings 210*a*, 210*b* and/or 210*d*.

Lock 300*f* comprises a lock member 320*f* slidingly disposed in seat 126*f* of light housing 110*f* for longitudinal movement therein. Lock member 320*f* comprises a lock blade 322*f* that has an angled end for ratcheting engagement of ridges or notches on head housing 210*f* and a tapered or wedge-shaped end 324*f*. Blade 322*f* is slid forward to be in position to engage lock 300*f* and is slid rearward to release lock 300*f*. One or more U-shaped springs 323*f* have tips with curved ends that are biased to move close together under its spring action. As a result, sliding lock member 320 away from the forward end of housing 210*f* (away from head housing 210*f*) causes springs 323*f* to be spread apart under tension to exert a force against the tapered end 324*f* of lock member 320*f* tending to return lock member 320*f* to the forward position whereat blade 322*f* can engage housing 210*f*.

With lock member 320*f* in the position of FIG. 13B, threading head housing 210*f* onto light housing 110*f* (e.g., by clockwise rotation) causes ridges 222*f* of housing 210*f* at the end of housing 210*f* to engage the angled end of blade 322*f* to move lock member 320*f* rearward in seat 126*f* against the bias of springs 323*f* until the tip of blade 322*f* has moved sufficiently rearward for the ridge 222*f* to ride over blade 322*f* and to allow blade 322*f* to return to the illustrated position ready to engage the next ridge 222*f*, thereby to ratchet lock member 320*f* as head housing 210*f* is placed on housing 110*f*. Head housing 210*f* cannot be rotated in the reverse direction (e.g., counter clockwise) because ridges or notches 222*f* thereon engage the straight side of blade 322*f* and press it against the side of seat 126*f*, thereby to prevent reverse rotation of head housing 210*f* which is thus locked on housing 110*f*. Thus, lock 300*f* can engage automatically by the ratcheting action of lock member 320*f*.

Lock member 320*f* includes a circular knob 326*f* having receptacle 328*f* thereon to provide features for engaging by a tool for releasing lock 300*f*, e.g., by a pair of spaced apart circular or semicircular recesses for being engaged by a tool having a pair of corresponding pins. The tool may be utilized for sliding lock member 320*f* forward and backward, e.g., to release lock 300*f*. Circular knob 326*f* may have a circular recess detent on one edge thereof for receiving a curved tip of spring 323*f* whereby lock member 320*f* is restrained in the rearward position against the action of springs 323*f* tending to move lock member 320*f* back to the forward or locking position.

Preferably, locking member 320*f* is free to slide forward and rearward so as to provide a ratcheting locking action, however, knob 326 may be rotatable and so may be rotated by a tool engaging receptacles 328*f* to rotate knob 326 into position to engage the tip of spring 323*f* when lock member is moved rearward by the tool. Preferably the edges of exposed features of lock member 320*f* and slot 314*f* are too small to be engaged by a human finger and so a tool is needed to release lock 300*f*. Lock member 320*f* may be a single piece or knob 326*f* may be a separate piece from blade 322*f* and rotatable relative thereto for easier release of spring 323*f* from the detent position.

While the provided one or plural recesses 222*f* that lock blade 322*f* enters may be castellated, the sides of the recesses 222*f* may be angled or tapered so as to facilitate lock blade 322*f* entering into one of recesses 222*f*. Further, the forward end of lock blade 322*f* may be angled so as to facilitate its entering a recess 222*f*.

In lock arrangement 300*f*, a tool is required to engage lock mechanism 300*f* or to move lock member 320*f* to an engaging position and a tool is required to release lock mechanism 300*f*. Lock member 320*f* and blade 322*f* are held captive to or are retained to light body housing 110*f* by cover 310*f* being mounted on light body housing 110*f*, and so no element of lock mechanism 300*f* is free of light 10 and so can not be misplaced or lost.

Figure 14A:
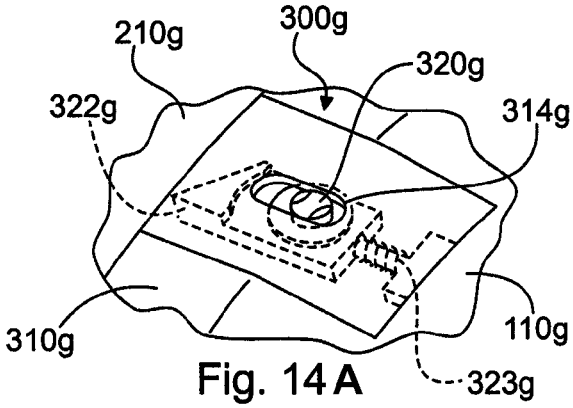
FIGS. 14A and 14B are perspective views of an alternative example lock arrangement in a released and in an engaged condition, respectively.
Figure 14B:
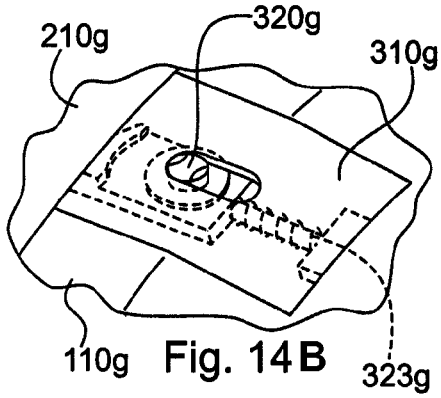
Figure 14C:
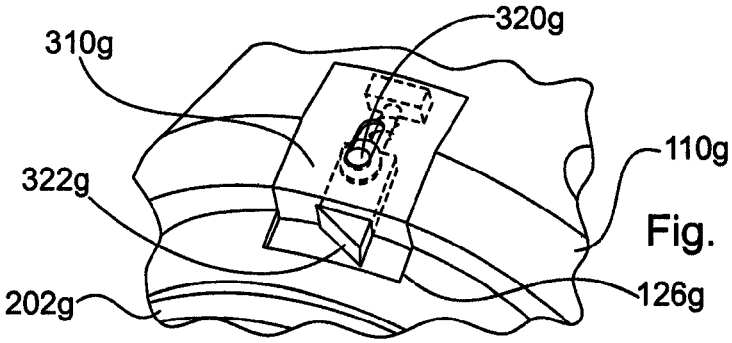
FIG. 14C is an exterior perspective view of an example housing therefor.

FIGS. 14A and 14B are perspective views of an alternative example lock arrangement 300*g* in a released and in an engaged condition, respectively, and FIG. 14C is an exterior perspective view of an example housing 110*g* therefor. Lock 300*g* is similar in operation to lock 300*f* in that a slidable locking member 320*g* having a blade 322*g* with an angled end is spring 323*g* biased forward to provide a ratcheting locking action against ridges or notches of a head housing. While a head housing 210*g* is not shown in these FIGURES, head housing 210*g* may be similar to head housings 210*a*, 210*b* and/or 210*d* and may have recesses, ridges and/or notches 222*g* similar to recesses, ridges and notches 222*a*, 222*b* and/or 222*d* of head housings 210*a*, 210*b* and/or 210*d*.

With lock member 320*g* in the position of FIG. 14B, threading head housing 210*g* onto light housing 110*g* (e.g., by clockwise rotation) causes ridges 222*g* at the end of housing 210*g* to engage the angled end of blade 322*g* to move lock member 320*g* rearward in seat 126*g* against the bias of spring 323*g* until the tip of blade 322*g* has moved sufficiently rearward for the ridge 222*g* to ride over blade 322*g* and to allow blade 322*g* to return to the illustrated position ready to engage the next ridge 222*g*, thereby to ratchet lock member 320*g* as head housing 210*g* is placed on housing 210*g*. Head housing 210*g* cannot be rotated in the reverse direction (e.g., counter clockwise) because ridges or notches 222*g* thereon engage the straight side of blade 322*g* and press it against the side of seat 126*f*, thereby to prevent reverse rotation of head housing

210*g* which is thus locked on housing 110*g*. Thus, lock 300*g* can engage automatically by the ratcheting action of lock member 320*g*.

Lock member 320*g* includes a circular knob 326*g* having receptacle 328*g* thereon to provide features for engaging by a tool for releasing lock 300*g*, e.g., by a pair of spaced apart circular or semicircular recesses for being engaged by a tool having a pair of corresponding pins. The tool may be utilized for sliding lock member 320*g* forward and backward, e.g., to release lock 300*g*. Circular knob 326*g* may have a projecting detent on one edge thereof for engaging a corresponding recess of cover 310*g* whereby lock member 320*g* may be restrained in the rearward position against the action of spring 323*g* tending to move lock member 320*g* back to the forward or locking position.

Preferably, locking member 320*g* is free to slide forward and rearward so as to provide a ratcheting locking action, however, knob 326*g* may be rotatable and so may be rotated by a tool engaging receptacles 328*g* to rotate knob 326*g* into position to engage cover 310*g* when lock member is moved rearward by the tool. Preferably the edges of exposed features of lock member 320*g* and slot 314*g* are too small to be engaged by a human finger and so a tool is needed to release lock 300*g*. Lock member 320*g* may be a single piece or knob 326*g* may be a separate piece from blade 322*g* and rotatable relative thereto for engaging cover 310 to retain lock member 320*g* in the rearward.

While the provided one or plural recesses 222*g* that lock blade 322*g* enters may be castellated, the sides of the recesses 222*g* may be angled or tapered so as to facilitate lock blade 322*g* entering into one of recesses 222*g*. Further, the forward end of lock blade 322*g* may be angled so as to facilitate its entering a recess 222*g*.

In lock arrangement 300*g*, a tool is required to engage lock mechanism 300*g* or to move lock member 320*g* to an engaging position and a tool is required to release lock mechanism 300*g*. Lock member 320*g* and blade 322*g* are held captive to or are retained to light body housing 110*g* by cover 310*g* being mounted on light body housing 110*g*, and so no element of lock mechanism 300*g* is free of light 10 and so can not be misplaced or lost.

Figure 15A:
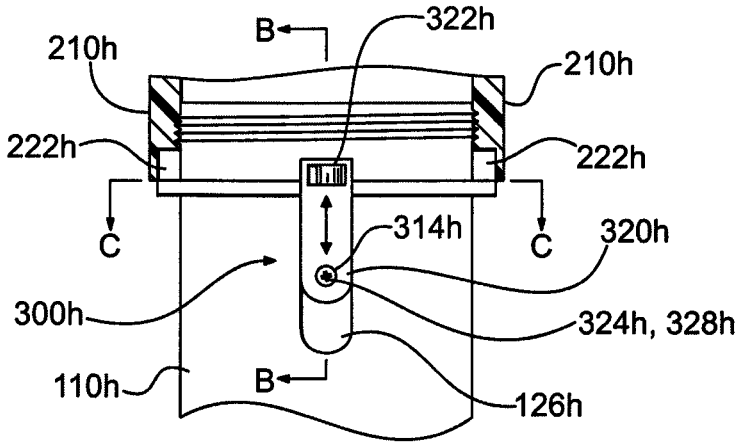
FIG. 15A is a plan view and FIGS. 15B and 15C are cross-sectional views of an alternative example lock arrangement.
Figure 15B:
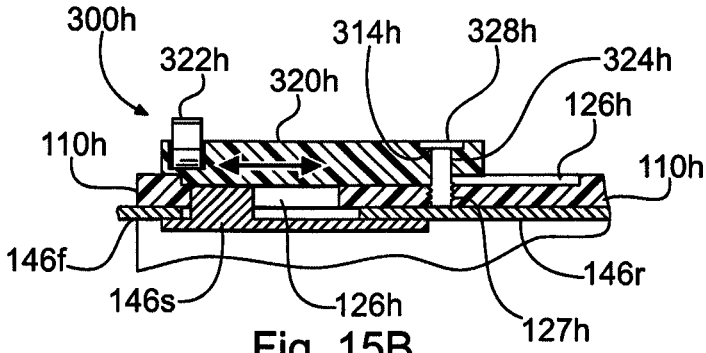
Figure 15C:
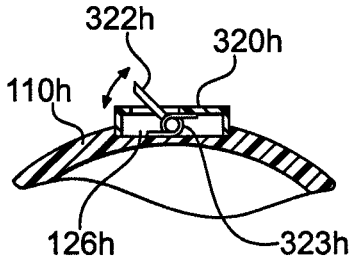

FIG. 15A is a plan view and FIGS. 15B and 15C are cross-sectional views of an alternative example lock arrangement 300*h*. Lock 310*h* includes a slidable lock member 320*h* that is slidable longitudinally along light body 110*h* so as to be placed in a forward position in which lock 300*h* may be engaged or in a rearward position in which lock 300*h* is disengaged. Light body housing 110*h* preferably has a slot and/or opening 126*h* therein in which lock member 320*h* is slidable forwardly and rearwardly. Preferably, opening 126*h* has a slot 126*h* through which member 320*h* extends to connect to slide contact 146*s* which serves to retain lock member 320*h* in slot 126*h* of housing 110*h* and has a longitudinal groove 126*h* in which lock member 320 is guided as it slides forwardly and rearwardly. Contact 146*s* and member 320*h* may be connected together by a pin, screw, snap, adhesive or other fastener so as to be slidably retained in opening 126*h*.

In the rearward position, lock member 320*h* is located sufficiently rearward on light body 110*h* so as to not engage a light head housing 210*h* when light head housing 210*h* is rotated to be threaded onto and off of the threads of light body housing 110*h*. In the forward position, e.g., as is shown in FIG. 15B, ratchet 322*h* of lock member 320*h* is biased by spring 323*h* to extend radially outward so as to ratchet for engaging ridges and/or recesses 222*h* in light head housing 210*h* when light head housing 210*h* is rotated to be threaded onto the threads of light body housing 110*h*. Light head housing 210*h* may have around its rear end one or more ridges and/or recesses that are open at the rear for receiving slidable member 320*h* therein, e.g., similarly to light head housings 210*a*, 210*b*, and/or 210*d* described herein.

With lock member 320*h* in the forward position, ratchet 322*h* is extended under the bias of spring 323*h* so as to be in position to engage a light head housing 210*h* when a light head housing 210*h* (shown in cross-section) is threaded onto light housing 110*h*. When a ridge 222*h* of light head housing 210*h* bears against ratchet 322*h* as light head 210*h* is rotated for being threaded onto light body 110*h*, ratchet 322*h* is moved thereby toward light body 110*h* sufficiently to allow the ridge 222*a* to pass and then ratchet 322*h* returns to its extended position by spring 323*h* (as indicated by the double-ended arrow) so as to prevent reversal (un-threading) of light head 210*h*. As a result, light head 210*h* is automatically locked onto light body 110*h* by lock 300*h*.

Lock member 320*h* is held in the forward position by screw 324*h* which engages a threaded hole 127*h* in light body 110*h*, e.g., a threaded insert 127*h* therein. Screw 324*h* has a tool socket 328*h* in the end or head thereof into which a tool may be inserted for rotating screw 324*h* for locking or engaging lock 300*h* and for disengaging or releasing lock 300*h*. Locking screw 324*h* may be configured for retaining slidable lock member 320 in a locked or engaged position in at least two different ways.

In a first configuration, screw 324*h* is held captive in an opening 314*h* in slidable lock member 320*h*, e.g., by a clip, E-ring or un-threaded (smooth) neck, and so the head 328*h* of screw 324*h* may be rotated causing screw 324*h* to become threaded into threaded hole or insert 127*h* when slidable lock member 320*h* is slid forward into the locking position, thereby to engage lock 300*h*. Screw 324*h* may be rotated in the other direction to become free of hole 127*h* of light body 110*h*, thereby to release lock 300*h* and lock member 320*h* for being slid forward and rearward into engaging and disengaging positions.

In a second configuration, screw 324*h* is retained in a threaded hole or insert 127*h* in light body 110*h*, e.g., in a threaded insert 127*h* therein. When screw 324*h* is rotated so as to be substantially threaded into hole 127*h*, head 328*h* thereof is below slidable lock member 320*h* and so lock member 320*h* is free to be slid forward and rearward. When lock member 320*h* is slid forward into the locking or engaging position, opening 314*h* in slidable lock member 320*h* is positioned over (e.g., coaxially) with the head 328*h* of screw 324*h*. With lock member 320*h* in this position, the head 328*h* of screw 324*h* may be rotated in one direction in threaded hole or insert 127*h* so as to raise head 328*h* away from light body 110*h* into opening 314*h* thereof, thereby to restrict lock member 320*h* from being slid and to engage lock 300*h*. With lock member 320*h* in this position, the head 328*h* of screw 324*h* may be rotated in the other direction in threaded hole or insert 127*h* so as to retract head 328*h* towards light body 110*h* and out of opening 314*h* thereof, thereby to release lock member 320*h* for being slid and to disengage lock 300*h*.

In order to remove light head housing 210*h* from light body 110*h*, lock member 320*h* must be slid rearward so that ratchet 322*h* thereof slides rearward to become disengaged from ridges and/or recesses 222*h* of light head 210*h* whereby light head housing 210*h* is unlocked (released) and then may be rotated to be removed from light body 110*h*.

Lock arrangement 300*h* further includes an electrical contact arrangement 146*f*, 146*r*, 146*s* for rendering light 10 inoperable when lock 300*h* is not locked or engaged. Electrical conductor 146 of light housing 110*h*, which provides, e.g., an electrical connection between the rearward end of a battery

120 of light 10 and the light source in head 200 thereof, is configured to have a forward portion 146*f* and a rearward portion 146*r* positioned to define a gap or space therebetween. Slidable lock member 320 includes an electrically conductive contact member 146*s* that slides forwardly and rearwardly with lock member 320 so as to provide or make an electrical connection between conductors 146*f* and 146*r* when lock member 320*h* is slid to the forward or locked position and to break the electrical connection between conductors 146*f* and 146*r* when lock member 320*h* is slid rearwardly from its locking position, e.g., to an unlocked or released position. Slide contact 146*s* may be in continuous sliding electrical contact with rear conductor 146*r* for all positions of lock member 320*h* and in electrical contact with forward conductor 146*f* only when lock member 320*h* is in the forward or locking position.

In lock arrangement 300*h*, a tool is required to retain lock mechanism 300*h* in the engaged position or to release lock member 320*h* to be moved from the engaged position, and so a tool is required to release lock mechanism 300*h*. Lock member 320*h*, blade 322*h* and screw 324*h* are held captive to or are retained to light body housing 110*h* by their being mounted to light body housing 110*h*, and so no element of lock mechanism 300*h* is free of light 10 and so can not be misplaced or lost.

In a typical embodiment of light 10, head housing 210 and light housing 110, including lock 300 cover 310, may be a plastic, e.g. a nylon, ABS, polycarbonate, acetal (POM), or other suitable plastic, with or without reinforcement and/or a filler and/or an anti-static element, e.g., a glass- or carbon-filled plastic. Lens 240 may be polycarbonate, acrylic, ABS, or other suitable plastic or glass. Locking member 320 may be aluminum, brass, copper, steel, stainless steel, plastic or other suitable material, and may have a tool socket 328 that receives a hexagonal or Allen-type wrench, e.g., a 7/64 inch (about 2.8 mm) Allen wrench, a cruciform tool or a spanner-type wrench. Typically, battery 120 is an alkaline battery, typically a C-size alkaline cell, but a carbon-zinc single use battery or a rechargeable lead-acid, Ni-CD, NiMH, or lithium-ion battery could be employed.

A portable light 10 having a safety lock 300-300*h* comprising: a light body 100, 110-110*h* having a compartment for receiving a source of electrical power through an opening of the light body 100, 110-110*h*; a light head 200, 210-210*h* including a light source 230 for producing light when energized, the light head 200, 210-210*h* for engaging the opening of the light body 100, 110-110*h* for covering the compartment thereof; a lock mechanism 300-300*h* including a lock member 320-320*h* for engaging the light body 100, 110-110*h* and the light head 200, 210-210*h* for preventing removal of the light head 200, 210-210*h* from the light body 100, 110-110*h* unless the lock mechanism 300-300*h* is released by a tool; and a lock cover 310-310*h* permanently attached to the light body 100, 110-110*h* or the light head 200, 210-210*h* for retaining the lock member 320-320*h*, wherein the lock member 320-320*h* is retained on the light body 100, 110-110*h* or on the light head 200, 210-210*h* by the lock cover 310-310*h* when the lock mechanism 300-300*h* is engaged and when the lock mechanism 300-300*h* is released. The lock member 320-320*h* may be mounted to one of the light body 100, 110-110*h* and the light head 200, 210-210*h*, the lock member 320-320*h* being movable to a first position for engaging the other of the light body 100, 110-110*h* and the light head 200, 210-210*h* and being releasable by a tool from the first position for releasing the other of the light body 100, 110-110*h* and the light head 200, 210-210*h*. The lock member 320-320*h* may comprise: a shaft 324-324*h* connected to a lock blade 322-322*h* for engaging and releasing the other of the light body 100, 110-110*h* and the light head 200, 210-210*h*, the shaft 324-324*h* having a tool interface 328-328*h* for receiving the tool; or a lock blade 322-322*h* movable for engaging and releasing the other of the light body 100, 110-110*h* and the light head 200, 210-210*h*, the lock member 320-320*h* having a tool interface 328-328*h* for receiving the tool. lock member 320-320*h* may comprise: a shaft 324-324*h* rotatable in a seat on the one of the light body 100, 110-110*h* and the light head 200, 210-210*h*, wherein the lock cover 310-310*h* retains the shaft 324-324*h* in the seat on the one of the light body 100, 110-110*h* and the light head 200, 210-210*h*; or a shaft 324-324*h* rotatable in a seat on the one of the light body 100, 110-110*h* and the light head 200, 210-210*h*, and a retainer engaging the shaft 324-324*h* for retaining the shaft 324-324*h* in the seat on the one of the light body 100, 110-110*h* and the light head 200, 210-210*h*; or a lock blade 322-322*h* movable in a seat on the one of the light body 100, 110-110*h* and the light head 200, 210-210*h*, wherein the lock cover 310-310*h* retains the lock blade 322-322*h* in the seat on the one of the light body 100, 110-110*h* and the light head 200, 210-210*h*; or a threaded shaft 324-324*h* rotatably engaging a threaded hole in one of the light body 100, 110-110*h* and the light head 200, 210-210*h*. The lock mechanism 300-300*h* may be engaged by a tool engaging the lock member 320-320*h* and may be released by a tool engaging the lock member 320-320*h*. The lock mechanism 300-300*h* may make an electrical connection 146, 146*s*, 146*f*, 146*r* in the light body 100, 110-110*h* when engaged and may break the electrical connection 146, 146*s*, 146*f*, 146*r* when not engaged. The light head 200, 210-210*h* may have a projection on an internal surface thereof and the light body 100, 110-110*h* may have a projection thereon, wherein the projection of the light body 100, 110-110*h* interferes with the projection of the light head 200, 210-210*h* when the light head 200, 210-210*h* engages the light body 100, 110-110*h* for aligning the light head 200, 210-210*h* and the light body 100, 110-110*h* for engaging the lock mechanism 300-300*h*. The lock mechanism 300-300*h* may provide a visual indication 321 of being engaged, or of being released, or of both. The source of electrical power may include one or more batteries.

A portable device having a safety lock comprising: a body 100, 110-110*h* having a compartment for receiving a source of electrical power through an opening of the body 100, 110-110*h*; a cover 200, 210-210*h* for engaging the opening of the body 100, 110-110*h* for covering the compartment thereof; a lock mechanism 300-300*h* including a lock member 320-320*h* for engaging the body 100, 110-110*h* and the cover 200, 210-210*h* for preventing removal of the cover 200, 210-210*h* from the body 100, 110-110*h* unless the lock mechanism 300-300*h* is released by a tool; and a lock cover 310-310*h* permanently attached to the body 100, 110-110*h* or the cover 200, 210-210*h* for retaining the lock member 320-320*h*, wherein the lock member 320-320*h* is retained on the body 100, 110-110*h* or on the cover 200, 210-210*h* by the lock cover 310-310*h* when the lock mechanism 300-300*h* is engaged and when the lock mechanism 300-300*h* is released. The portable device may be a portable light 10 wherein the cover 200, 210-210*h* includes a light source 230 for producing light when energized. The lock member 320-320*h* may be mounted to one of the body 100, 110-110*h* and the cover 200, 210-210*h*, the lock member 320-320*h* being movable to a first position for engaging the other of the body 100, 110-110*h* and the cover 200, 210-210*h* and being releasable by a tool from the first position for releasing the other of the body 100, 110-110*h* and the cover 200, 210-210*h*. The lock member 320-320*h* may comprise: a shaft 324-324*h* connected to a lock blade 322-322*h* for engaging and releasing the other of the body 100, 110-110*h* and the cover 200, 210-210*h*, the shaft 324-324*h* having a tool interface 328-328*h* for receiving the tool; or a lock blade 322-322*h* movable for engaging and releasing the other of the body 100, 110-110*h* and the cover 200, 210-210*h*, the lock member 320-320*h* having a tool interface 328-328*h* for receiving the tool. The lock member 320-320*h* may comprise: a shaft 324-324*h* rotatable in a seat on the one of the body 100, 110-110*h* and the cover 200, 210-210*h*, wherein the lock cover 310-310*h* retains the shaft 324-324*h* in the seat on the one of the body 100, 110-110*h* and the cover 200, 210-210*h*; or a shaft 324-324*h* rotatable in a seat on the one of the body 100, 110-110*h* and the cover 200, 210-210*h*, and a retainer engaging the shaft 324-324*h* for retaining the shaft 324-324*h* in the seat on the one of the body 100, 110-110*h* and the cover 200, 210-210*h*; or a lock blade 322-322*h* movable in a seat on the one of the body 100, 110-110*h* and the cover 200, 210-210*h*, wherein the lock cover 310-310*h* retains the lock blade 322-322*h* in the seat on the one of the body 100, 110-110*h* and the cover 200, 210-210*h*; or a threaded shaft 324-324*h* rotatably engaging a threaded hole in one of the body 100, 110-110*h* and the cover 200, 210-210*h*. The lock mechanism 300-300*h* may be engaged by a tool engaging the lock member 320-320*h* and may be released by a tool engaging the lock member 320-320*h*. The lock mechanism 300-300*h* may make an electrical connection 146, 146*s*, 146*f*, 146*r* in the body 100, 110-110*h* when engaged and may break the electrical connection 146, 146*s*, 146*f*, 146*r* when not engaged. The cover 200, 210-210*h* may have a projection on an internal surface thereof and the body 100, 110-110*h* may have a projection thereon, wherein the projection of the body 100, 110-110*h* interferes with the projection of the cover 200, 210-210*h* when the cover 200, 210-210*h* engages the body 100, 110-110*h* for aligning the cover 200, 210-210*h* and the body 100, 110-110*h* for engaging the lock mechanism 300-300*h*. The lock mechanism 300-300*h* may provide a visual indication 321 of being engaged, or of being released, or of both. The source of electrical power may include one or more batteries.

A portable light 10 having a safety lock comprising: a light body 100, 110-110*h* having a compartment for receiving a source of electrical power through an opening of the light body 100, 110-110*h*; a cover 200, 210-210*h* for engaging the opening of the light body 100, 110-110*h* for covering the compartment thereof; a light source 230 for producing light when energized, wherein the light source 230 is supported by the light body 100, 110-110*h* or by the cover 200, 210-210*h*; a lock mechanism 300-300*h* including a lock member 320-320*h* for engaging the light body 100, 110-110*h* and the cover 200, 210-210*h* for preventing removal of the cover 200, 210-210*h* from the light body 100, 110-110*h* unless the lock mechanism 300-300*h* is released by a tool; and a lock cover 310-310*h* permanently attached to the light body 100, 110-110*h* or the cover 200, 210-210*h* for retaining the lock member 320-320*h*, wherein the lock member 320-320*h* is retained on the light body 100, 110-110*h* or on the cover 200, 210-210*h* by the lock cover 310-310*h* when the lock mechanism 300-300*h* is engaged and when the lock mechanism 300-300*h* is released. The portable light 10 wherein: the lock member 320-320*h* may be mounted to one of the light body 100, 110-110*h* and the cover 200, 210-210*h*, the lock member 320-320*h* being movable to a first position for engaging the other of the light body 100, 110-110*h* and the cover 200, 210-210*h* and being releasable by a tool from the first position for releasing the other of the light body 100, 110-110*h* and the cover 200, 210-210*h*; or the lock member 320-320*h* may be mounted to one of the light body 100, 110-110*h* and the light source 200, 210-210*h*, 230, the lock member 320-320*h* being movable to a first position for engaging the other of the light body 100, 110-110*h* and the light source 200, 210-210*h*, 230 and being releasable by a tool from the first position for releasing the other of the light body 100, 110-110*h* and the light source 200, 210-210*h*, 230. The lock member 320-320*h* may comprise: a shaft 324-324*h* connected to a lock blade 322-322*h* for engaging and releasing the other of the light body 100, 110-110*h* and the cover 200, 210-210*h* or light source 200, 210-210*h*, 230, the shaft 324-324*h* having a tool interface 328-328*h* for receiving the tool; or a lock blade 322-322*h* movable for engaging and releasing the other of the light body 100, 110-110*h* and the cover 200, 210-210*h* or light source 200, 210-210*h*, 230, the lock member 320-320*h* having a tool interface 328-328*h* for receiving the tool. The lock member 320-320*h* may comprise: a shaft 324-324*h* rotatable in a seat on the one of the light body 100, 110-110*h* and the cover 200, 210-210*h* or light source 200, 210-210*h*, 230, wherein the lock cover 310-310*h* retains the shaft 324-324*h* in the seat on the one of the light body 100, 110-110*h* and the cover 200, 210-210*h* or light source 200, 210-210*h*, 230; or a shaft 324-324*h* rotatable in a seat on the one of the light body 100, 110-110*h* and the cover 200, 210-210*h* or light source 200, 210-210*h*, 230, and a retainer engaging the shaft 324-324*h* for retaining the shaft 324-324*h* in the seat on the one of the light body 100, 110-110*h* and the cover 200, 210-210*h* or light source 200, 210-210*h*, 230; or a lock blade 322-322*h* movable in a seat on the one of the light body 100, 110-110*h* and the cover 200, 210-210*h* or light source 200, 210-210*h*, 230, wherein the lock cover 310-310*h* retains the lock blade 322-322*h* in the seat on the one of the light body 100, 110-110*h* and the cover 200, 210-210*h* or light source 200, 210-210*h*, 230; or a threaded shaft 324-324*h* rotatably engaging a threaded hole in one of the light body 100, 110-110*h*, the light head 200, 210-210*h* and the cover 200, 210-210*h*. The lock mechanism 300-300*h* may be engaged by a tool engaging the lock member 320-320*h* and may be released by a tool engaging the lock member 320-320*h*. The lock mechanism 300-300*h* may make an electrical connection 146, 146*s*, 146*f*, 146*r* in the light body 100, 110-110*h* when engaged and may break the electrical connection 146, 146*s*, 146*f*, 146*r* when not engaged. The cover 200, 210-210*h* may have a projection on an internal surface thereof and the light body 100, 110-110*h* may have a projection thereon, wherein the projection of the light body 100, 110-110*h* interferes with the projection of the cover 200, 210-210*h* when the cover 200, 210-210*h* engages the light body 100, 110-110*h* for aligning the cover 200, 210-210*h* and the light body 100, 110-110*h* for engaging the lock mechanism 300-300*h*. The lock mechanism 300-300*h* may provide a visual indication 321 of being engaged, or of being released, or of both. The source of electrical power may include one or more batteries.

A portable light 10 having a safety lock comprising: a light body 100, 110-110*h* having a compartment for receiving one or more batteries through an open threaded end of the light body 100, 110-110*h*; a light head 200, 210-210*h* including a light source 230 for producing light when energized, the light head 200, 210-210*h* for engaging the open threaded end of the light body 100, 110-110*h* for covering the compartment thereof; a lock member 320-320*h* movably retained on one of the light body 100, 110-110*h* and the light head 200, 210-210*h*, the lock member 320-320*h* being movable to a first position for engaging the other of the light body 100, 110-110*h* and the light head 200, 210-210*h* and being releasable by a tool from the first position for disengaging the other of the light body 100, 110-110*h* and the light head 200, 210-210*h*; a lock cover 310-310*h* permanently attached to the light body 100, 110-110*h* or the light head 200, 210-210*h* for retaining the lock member 320-320*h*, wherein the lock member 320-320*h* is retained on the one of the light body 100, 110-110*h* and the light head 200, 210-210*h* by the lock cover 310-310*h* when the lock member 320-320*h* is engaging the other of the light body 100, 110-110*h* and the light head 200, 210-210*h* and when the lock member 320-320*h* is disengaged from the other of the light body 100, 110-110*h* and the light head 200, 210-210*h*; and the lock member 320-320*h* comprising a shaft 324-324*h* having a lock blade 322-322*h* for engaging and releasing at least the other of the light body 100, 110-110*h* and the light head 200, 210-210*h*, the shaft 324-324*h* having a tool interface 328-328*h* for receiving the tool, wherein the lock member 320-320*h* engages the light body 100, 110-110*h* and the light head 200, 210-210*h* for preventing removal of the light head 200, 210-210*h* from the light body 100, 110-110*h* unless the lock member 320-320*h* is moved by a tool. The lock member 320-320*h* may be moved for the engaging the other of the light body 100, 110-110*h* and the light head 200, 210-210*h* by a tool engaging the lock member 320-320*h* and may be moved for the releasing the other of the light body 100, 110-110*h* and the light head 200, 210-210*h* by a tool engaging the lock member 320-320*h*. The lock member 320-320*h* may make an electrical connection 146, 146*s*, 146*f*, 146*r* in the light body 100, 110-110*h* when engaged and may break the electrical connection 146, 146*s*, 146*f*, 146*r* when not engaged. The light head 200, 210-210*h* may have a ridge on an internal surface thereof and the light body 100, 110-110*h* may have a shoulder thereon, wherein the ridge of the light head 200, 210-210*h* interferes with the shoulder of the light body 100, 110-110*h* when the light head 200, 210-210*h* engages the light body 100, 110-110*h* for aligning the light head 200, 210-210*h* and the light body 100, 110-110*h* for engaging the lock member 320-320*h*.

A portable light 10 having a safety lock comprising: a light body 100, 110-110*h* having a compartment for receiving one or more batteries through an open threaded end of the light body 100, 110-110*h*; a light head 200, 210-210*h* including a light source 230 for producing light when energized, the light head 200, 210-210*h* for engaging the open threaded end of light body 100, 110-110*h* for covering the compartment thereof; a lock member 320-320*h* movably retained on one of the light body 100, 110-110*h* and the light head 200, 210-210*h*, the lock member 320-320*h* being movable to a first position for engaging the other of the light body 100, 110-110*h* and the light head 200, 210-210*h* and being releasable by a tool from the first position for disengaging the other of the light body 100, 110-110*h* and the light head 200, 210-210*h*; a lock pin 126*p* permanently attached to the one of the light body 100, 110-110*h* and the light head 200, 210-210*h* for retaining lock member 320*d*, wherein the lock member 320*d* is retained on the one of the light body 100, 110-110*h* and the light head 200, 210-210*h* by the lock pin 126*p* when lock member 320*d* is engaging the other of the light body 100, 110-110*h* and the light head 200, 210-210*h* and when the lock member 320*d* is disengaged from the other of the light body 100, 110-110*h* and the light head 200, 210-210*h*; and the lock member 320*d* comprising a latch plate 320*d* and a latch clip 322*d* for engaging and releasing at least the other of the light body 100, 110-110*h* and the light head 200, 210-210*h*, the lock member 320*d* further including a screw 328*d* rotatably and captively mounted to the latch plate 320*d* and having a tool interface 328*d* for receiving the tool, wherein the lock member 320*d* engages the light body 100, 110-110*h* and the light head 200, 210-210*h* for preventing removal of light head 200, 210-210*h* from the light body unless the screw 328*d* of the lock member 320*d* is moved by a tool.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate"whether or not expressly stated to be such. It is noted that embodiments of very different sizes, shapes and dimensions may employ the described arrangements.

Although terms such as "up," "down," "left," "right," "front," "rear," "side," "top," "bottom," "forward," "backward," "under" and/or "over," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed. Similarly, terms such as ridge, rib, recess, shoulder and the like may be used as convenient and interchangeably because ridges and ribs define recesses therebetween and because recesses define ridges or shoulders at their edges. Double-ended arrows are used to indicate the direction or directions of movement for movable parts.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable device.

While the present invention has been described in terms of the foregoing example embodiments, variations within the scope and spirit of the present invention as defined by the claims following will be apparent to those skilled in the art. For example, while the example embodiment described has a lock in relation to a light head that is removable from the light, the removable part or parts protected by a lock arrangement could be another part of the light, e.g., a tail cap or a battery compartment cover.

Alternatively, tool interface 328-328*g* may have a relatively simple or common shape, such as a slot for receiving a flat blade screwdriver or a cruciform shape (a cross "+" shape) for receiving a cross-shaped tool, e.g., a Philip's head screwdriver, or interface or receptacle 328 may have a more complex shape, e.g., such as a hexagonal shape for receiving a hexagonal tool, e.g., an Allen wrench, or may have a ribbed wall for receiving a ribbed tool, e.g., a Torx® driver tool, or may have spaced apart recesses for receiving a tool having spaced apart pins, e.g., a spanner wrench, or another less common or even non-standard tool. Moreover, the light or device 10 may have a receptacle or other feature for storing the tool, may have a tool that is connected, e.g., via a tether or lanyard, or may have a tool intended to be kept separate from the light or device, e.g., in a non-hazardous area or under the control of a supervisor or other responsible or designated person.

Further, tool interface is used herein to refer to generally to a tool interface, and need not be a recess, e.g., as would receive a hexagonal or Allen wrench. Such tool interface can be a projection or other feature that receives a tool having a recess or socket, e.g., a triangular, square or hexagonal nut driver, and the like.

Housing 210-210*g* typically provides a cover for the opening in the light or device body through which a source of electrical power, e.g., a battery, may be placed into a compartment in the light or device body, however, housing 210-210*g* may be a cover for the opening to the compartment and the light source or other operative element of the light or other portable device may be supported by the light or device body or by another cover or housing.

While cover 310 is in a preferred embodiment heat staked to housing 110 by posts 112, cover 310 may be attached thereto by ultrasonic, heat or chemical welding, by adhesive, by a snap fit, or by another suitable means.

Visual indication 321 indicative of the engaged or released condition of lock 300-300*h* may be provided by one or more surfaces of lock member 320-320*h*, or may be provided by any suitable surface that either is exposed when lock 300-300*h* is engaged and not exposed when lock 300-300*h* is released, or is hidden when lock 300-300*h* is engaged and is exposed when lock 300-300*h* is released, e.g., such as the surface of opening 222*c*, or of lock blade 322*b*, or of lock member 320*f*-320*g*, or of slot 126*h*, or an opening in the end of head housing 210*a*-210*b*, or another suitable surface or opening.

Where one part is described as having a projection that contacts or engages a recess in another part, the other part may have a projection and the one part may have a recess for effecting engagement, or both parts could have respective projections. In other words, the parts have complementary parts that engage, e.g., engaging features.

In many of the foregoing lock arrangements, e.g., locks 300, 300*a*, 300*b*, 300*c*, 300*e*, 300*f*, 300*g*, 300*h*, plural recesses 222-222*h* may be provided and may have castellated ends. The ends between recesses 222-222*h* may be narrowed and/or the recesses 222-222*h* may be tapered so as to facilitate lock blade 322-322*h* entering into one of recesses 222-222*h*. Further, the forward end of lock blade 322-322*h* may be rounded or tapered so as to facilitate its entering a recess 222-222*h*.

Each of the U.S. Provisional Applications, U.S. Patent Applications, and/or U.S. Patents identified herein are hereby incorporated herein by reference in their entirety, for any purpose and for all purposes irrespective of how it may be referred to herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light having a safety lock comprising:

a light body having a compartment for receiving a source of electrical power through an opening of said light body;

a light head including a light source for producing light when energized, said light head for engaging the opening of said light body for covering the compartment thereof;

a lock mechanism including a lock member movable for engaging said light body and said light head for preventing removal of said light head from said light body unless said lock mechanism is released by a tool; and a lock cover permanently attached to said light body or said light head and thereby movably retaining said lock member thereto, wherein said lock member is movably retained on said light body or on said light head by said lock cover when said lock mechanism is engaged and when said lock mechanism is released.

2. The portable light of claim 1 wherein said lock member is mounted to one of said light body and said light head, said lock member being movable to a first position for engaging the other of said light body and said light head and being releasable by a tool from the first position for releasing the other of said light body and said light head.

3. The portable light of claim 2 wherein said lock member comprises:

a shaft connected to a lock blade for engaging and releasing the other of said light body and said light head, the shaft having a tool interface for receiving the tool; or a lock blade movable for engaging and releasing the other of said light body and said light head, the lock member having a tool interface for receiving the tool.

4. The portable light of claim 2 wherein said lock member comprises:

a shaft rotatable in a seat on the one of said light body and said light head, wherein said lock cover retains the shaft in the seat on the one of said light body and said light head; or a shaft rotatable in a seat on the one of said light body and said light head, and a retainer engaging the shaft for retaining the shaft in the seat on the one of said light body and said light head; or a lock blade movable in a seat on the one of said light body and said light head, wherein said lock cover retains the lock blade in the seat on the one of said light body and said light head; or a threaded shaft rotatably engaging a threaded hole in one of said light body and said light head.

5. The portable light of claim 1 wherein said lock mechanism is engaged by a tool engaging said lock member and is released by a tool engaging said lock member.

6. The portable light of claim 1 wherein said lock mechanism makes an electrical connection in said light body when engaged and breaks the electrical connection when not engaged.

7. The portable light of claim 1 wherein said light head has a projection on an internal surface thereof and wherein said light body has a projection thereon, wherein the projection of said light body interferes with the projection of said light head when said light head engages said light body for aligning said light head and said light body for engaging said lock mechanism.

8. The portable light of claim 1 wherein said lock mechanism provides a visual indication of being engaged, or of being released, or of both.

9. The portable light of claim 1 wherein the source of electrical power includes one or more batteries.

10. A portable device having a safety lock comprising:

a body having a compartment for receiving a source of electrical power through an opening of said body;

a cover for engaging the opening of said body for covering the compartment thereof;

a lock mechanism including a lock member movable for engaging said body and said cover for preventing removal of said cover from said body unless said lock mechanism is released by a tool; and a lock cover permanently attached to said body or said cover and thereby movably retaining said lock member thereto, wherein said lock member is movably retained on said body or on said cover by said lock cover when said lock mechanism is engaged and when said lock mechanism is released.

11. The portable device of claim 10 wherein said device is a portable light and wherein said cover includes a light source for producing light when energized.

12. The portable device of claim 10 wherein said lock member is mounted to one of said body and said cover, said lock member being movable to a first position for engaging the other of said body and said cover and being releasable by a tool from the first position for releasing the other of said body and said cover.

13. The portable device of claim 12 wherein said lock member comprises:

a shaft connected to a lock blade for engaging and releasing the other of said body and said cover, the shaft having a tool interface for receiving the tool; or a lock blade movable for engaging and releasing the other of said body and said cover, the lock member having a tool interface for receiving the tool.

14. The portable device of claim 12 wherein said lock member comprises:

a shaft rotatable in a seat on the one of said body and said cover, wherein said lock cover retains the shaft in the seat on the one of said body and said cover; or a shaft rotatable in a seat on the one of said body and said cover, and a retainer engaging the shaft for retaining the shaft in the seat on the one of said body and said cover; or a lock blade movable in a seat on the one of said body and said cover, wherein said lock cover retains the lock blade in the seat on the one of said body and said cover; or a threaded shaft rotatably engaging a threaded hole in one of said body and said cover.

15. The portable device of claim 10 wherein said lock mechanism is engaged by a tool engaging said lock member and is released by a tool engaging said lock member.

16. The portable device of claim 10 wherein said lock mechanism makes an electrical connection in said body when engaged and breaks the electrical connection when not engaged.

17. The portable device of claim 10 wherein said cover has a projection on an internal surface thereof and wherein said body has a projection thereon, wherein the projection of said body interferes with the projection of said cover when said cover engages said body for aligning said cover and said body for engaging said lock mechanism.

18. The portable device of claim 10 wherein said lock mechanism provides a visual indication of being engaged, or of being released, or of both.

19. The portable device of claim 10 wherein the source of electrical power includes one or more batteries.

20. A portable light having a safety lock comprising:

a light body having a compartment for receiving a source of electrical power through an opening of said light body;

a cover for engaging the opening of said light body for covering the compartment thereof;

a light source for producing light when energized, wherein said light source is supported by said light body or by said cover;

a lock mechanism including a lock member movable for engaging said light body and said cover for preventing removal of said cover from said light body unless said lock mechanism is released by a tool; and a lock cover permanently attached to said light body or said cover and thereby movably retaining said lock member thereto, wherein said lock member is movably retained on said light body or on said cover by said lock cover when said lock mechanism is engaged and when said lock mechanism is released.

21. The portable light of claim 20 wherein:

said lock member is mounted to one of said light body and said cover, said lock member being movable to a first position for engaging the other of said light body and said cover and being releasable by a tool from the first position for releasing the other of said light body and said cover; or said lock member is mounted to one of said light body and said light source, said lock member being movable to a first position for engaging the other of said light body and said light source and being releasable by a tool from the first position for releasing the other of said light body and said light source.

22. The portable light of claim 21 wherein said lock member comprises:

a shaft connected to a lock blade for engaging and releasing the other of said light body and said cover or light source, the shaft having a tool interface for receiving the tool; or a lock blade movable for engaging and releasing the other of said light body and said cover or light source, the lock member having a tool interface for receiving the tool.

23. The portable light of claim 21 wherein said lock member comprises:

a shaft rotatable in a seat on the one of said light body and said cover or light source, wherein said lock cover retains the shaft in the seat on the one of said light body and said cover or light source; or a shaft rotatable in a seat on the one of said light body and said cover or light source, and a retainer engaging the shaft for retaining the shaft in the seat on the one of said light body and said cover or light source; or a lock blade movable in a seat on the one of said light body and said cover or light source, wherein said lock cover retains the lock blade in the seat on the one of said light body and said cover or light source; or a threaded shaft rotatably engaging a threaded hole in one of said light body, said light head and said cover.

24. The portable light of claim 20 wherein said lock mechanism is engaged by a tool engaging said lock member and is released by a tool engaging said lock member.

25. The portable light of claim 20 wherein said lock mechanism makes an electrical connection in said light body when engaged and breaks the electrical connection when not engaged.

26. The portable light of claim 20 wherein said cover has a projection on an internal surface thereof and wherein said light body has a projection thereon, wherein the projection of said light body interferes with the projection of said cover when said cover engages said light body for aligning said cover and said light body for engaging said lock mechanism.

27. The portable light of claim 20 wherein said lock mechanism provides a visual indication of being engaged, or of being released, or of both.

28. The portable light of claim 20 wherein the source of electrical power includes one or more batteries.

29. A portable light having a safety lock comprising:

a light body having a compartment for receiving one or more batteries through an open threaded end of said light body;

a light head including a light source for producing light when energized, said light head for engaging the open threaded end of said light body for covering the compartment thereof;

a lock member movably retained on one of said light body and said light head, said lock member being movable to a first position for engaging the other of said light body and said light head and being releasable by a tool from the first position for disengaging the other of said light body and said light head;

a lock cover permanently attached to said one of said light body and said light head and thereby movably retaining said lock member thereto, wherein said lock member is movably retained on the one of said light body and said light head by said lock cover when said lock member is engaging the other of said light body and said light head and when said lock member is disengaged from the other of said light body and said light head; and said lock member comprising a shaft having a lock blade for engaging and releasing at least the other of said light body and said light head, the shaft having a tool interface for receiving the tool, wherein said lock member engages said light body and said light head for preventing removal of said light head from said light body unless said lock member is moved by a tool.

30. The portable light of claim 29 wherein said lock member is moved for the engaging the other of said light body and said light head by a tool engaging said lock member and is moved for the releasing the other of said light body and said light head by a tool engaging said lock member.

31. The portable light of claim 29 wherein said lock member makes an electrical connection in said light body when engaged and breaks the electrical connection when not engaged.

32. The portable light of claim 29 wherein said light head has a ridge on an internal surface thereof and wherein said light body has a shoulder thereon, wherein the ridge of said light head interferes with the shoulder of said light body when said light head engages said light body for aligning said light head and said light body for engaging said lock member.

33. A portable light having a safety lock comprising:

a light body having a compartment for receiving one or more batteries through an open threaded end of said light body;

a light head including a light source for producing light when energized, said light head for engaging the open threaded end of said light body for covering the compartment thereof;

a lock member movably retained on one of said light body and said light head, said lock member being movable to a first position for engaging the other of said light body and said light head and being releasable by a tool from the first position for disengaging the other of said light body and said light head;

a lock pin permanently attached to said one of said light body and said light head for retaining said lock member thereto, wherein said lock member is movably retained on the one of said light body and said light head by said lock pin when said lock member is engaging the other of said light body and said light head and when said lock member is disengaged from the other of said light body and said light head; and said lock member comprising a latch plate and a latch clip for engaging and releasing at least the other of said light body and said light head, said lock member further including a screw rotatably and captively mounted to the latch plate and having a tool interface for receiving the tool, wherein said lock member engages said light body and said light head for preventing removal of said light head from said light body unless the screw of said lock member is moved by a tool.

* * * * *